US010959539B2

(12) United States Patent
Renno et al.

(10) Patent No.: US 10,959,539 B2
(45) Date of Patent: Mar. 30, 2021

(54) MODULAR TABLE AND WALKER

(71) Applicant: KIDS2, INC., Atlanta, GA (US)

(72) Inventors: Shadi Renno, Sandy Springs, GA (US); Blake Pomeroy, New Market, MD (US)

(73) Assignee: KIDS2, INC., Atlanta, GA (US)

( * ) Notice: Subject to any disclaimer, the term of this patent is extended or adjusted under 35 U.S.C. 154(b) by 0 days.

(21) Appl. No.: 16/571,647

(22) Filed: Sep. 16, 2019

(65) Prior Publication Data

US 2020/0085207 A1 Mar. 19, 2020

Related U.S. Application Data

(60) Provisional application No. 62/732,978, filed on Sep. 18, 2018.

(51) Int. Cl.

| | |
|---|---|
| ***A63B 22/20*** | (2006.01) |
| ***A47D 13/04*** | (2006.01) |
| ***A47D 15/00*** | (2006.01) |
| ***A47D 1/00*** | (2006.01) |

(52) U.S. Cl.

CPC ..... *A47D 13/043* (2013.01); *A47D 1/0085* (2017.05); *A47D 15/00* (2013.01)

(58) Field of Classification Search

CPC ..... A47B 13/10; A47B 2200/0079; A47B 83/001; A47B 83/04; A47B 7/002; A47B 13/088; A47B 3/06; A47B 13/003; A47B 21/06; A47B 2013/024; A47D 13/043; A47D 13/04; A47D 13/107; A47D 13/046; A47D 3/005; A47D 13/105; A47D 1/002; A47D 11/002; A61H 3/008; A61H 2201/0192

See application file for complete search history.

(56) References Cited

U.S. PATENT DOCUMENTS

| | | | |
|---|---|---|---|
| 68,637 | A | 9/1867 | Mason |
| 71,220 | A | 11/1867 | Rohr |
| 82,304 | A | 9/1868 | Geisler |
| 124,706 | A | 3/1872 | Westlake et al. |
| 341,167 | A | 5/1886 | Pudder |
| 368,477 | A | 9/1887 | Lane et al. |
| 451,128 | A | 4/1891 | Lawson |
| 671,058 | A | 4/1901 | Resetar |
| 822,329 | A | 6/1906 | Wilcox |

(Continued)

FOREIGN PATENT DOCUMENTS

CN 104055319 A 9/2014

OTHER PUBLICATIONS

Chinese First Office for App. No. 201921556712.6; dated May 25, 2020; 2 pgs.

*Primary Examiner* — Shin H Kim

(74) *Attorney, Agent, or Firm* — Gardner Groff & Greenwald, PC

(57) ABSTRACT

A children's play table and walker including modular table accessory panels for interchangeable use, and a walker rotationally mounted to move around the table. The seat may be removable so that the table can be used independently as the child grows. A modular tabletop assembly allows for customization of a table for different purposes or different developmental stages of a child. A gravity-assisted connection between a tabletop assembly and a table base assists in assembly of the table.

34 Claims, 19 Drawing Sheets

(56) References Cited

U.S. PATENT DOCUMENTS 903,731 A 11/1908 Kull
1,297,018 A 3/1919 Scott
1,297,800 A 3/1919 Cranford
1,437,179 A 11/1922 Herson
1,469,436 A 10/1923 Fornia
D119,382 S 3/1940 Depuy
2,308,626 A 1/1943 Reinholz
2,352,450 A 6/1944 Reinholz
2,499,164 A 2/1950 Richardson
3,049,350 A 8/1962 Walker
3,127,170 A 3/1964 Caster
3,303,797 A 2/1967 Mueller
3,437,390 A * 4/1969 Evans ..... A47B 87/002 312/237
3,533,362 A * 10/1970 Thompson ..... A47B 87/002 108/64
3,721,437 A 3/1973 Skaricic
3,730,587 A 5/1973 Bloxham et al.
3,741,852 A * 6/1973 Keener ..... A47B 87/002 428/80
D233,088 S * 10/1974 Sharky ..... D6/649
3,985,082 A 10/1976 Barac
D280,368 S * 9/1985 Crespi ..... D6/696.1
4,621,804 A 11/1986 Mueller
4,743,008 A 5/1988 Fermaglich et al.
4,795,151 A 1/1989 Mulcaster
4,907,571 A 3/1990 Futakami
4,922,835 A * 5/1990 Van Vliet ..... A47B 3/12 108/185
5,016,405 A * 5/1991 Lee ..... A47B 83/001 108/60
5,050,504 A 9/1991 Mulcaster
D320,528 S 10/1991 Bernstein et al.
5,085,428 A 2/1992 Fermaglich et al.
5,197,394 A 3/1993 Schmidt
5,211,607 A 5/1993 Fermaglich et al.
5,237,937 A 8/1993 Peltier et al.
5,302,163 A 4/1994 Fermaglich et al.
5,366,231 A 11/1994 Hung
5,409,246 A 4/1995 Ali
5,433,682 A 7/1995 Fermaglich et al.
5,438,937 A * 8/1995 Ball ..... A47B 87/002 108/64
5,577,801 A 11/1996 Glockl
5,590,892 A 1/1997 Hu
5,622,118 A * 4/1997 Rowan ..... A47B 1/00 108/65
5,673,631 A * 10/1997 Guns ..... A47B 87/002 108/64
5,688,211 A 11/1997 Myers
5,735,220 A * 4/1998 Wang ..... A47B 1/10 108/87
5,967,058 A * 10/1999 Ambrose ..... A47B 13/10 108/64
6,000,750 A 12/1999 Rossman et al.
6,001,047 A 12/1999 Ferrara
6,048,290 A 4/2000 Chen et al.
6,182,581 B1 * 2/2001 Boyce ..... A47B 3/12 108/64
6,299,247 B1 10/2001 Meeker et al.
6,363,866 B1 * 4/2002 Schwartz ..... A47B 13/10 108/64
D465,440 S 11/2002 Ventrola et al.
6,477,966 B1 11/2002 Petryna
6,616,629 B1 9/2003 Verin et al.
6,837,386 B1 1/2005 Kent et al.
7,025,364 B1 4/2006 Clarke
7,097,599 B2 8/2006 Gates
7,168,199 B2 1/2007 Krien
7,247,100 B2 7/2007 Jackson et al.
7,326,152 B2 2/2008 Gates
7,507,162 B2 * 3/2009 Jackson ..... A47D 13/04 472/14
D618,474 S * 6/2010 Maddadi ..... D6/644
8,397,651 B2 * 3/2013 Levy ..... A47B 87/002 108/64
8,475,342 B2 9/2013 Flowers et al.
8,950,805 B2 2/2015 Azumi et al.
8,997,661 B1 4/2015 Kilday
D745,798 S * 12/2015 Legare ..... D6/707.22
D770,207 S * 11/2016 Legare ..... D6/707.22
D774,338 S * 12/2016 Legare ..... D6/707.22
D786,595 S * 5/2017 Mingenbach ..... D6/707.18
D839,648 S * 2/2019 Legare ..... D6/707
10,492,608 B2 * 12/2019 Baloga ..... A47B 83/04
2002/0164917 A1 * 11/2002 Keegan ..... A47D 13/107 446/71
2005/0247241 A1 * 11/2005 Sherman ..... A47B 13/088 108/64
2006/0117669 A1 * 6/2006 Baloga ..... A47B 87/002 52/8
2006/0180055 A1 * 8/2006 Mulmed ..... A47B 87/007 108/64
2007/0124981 A1 6/2007 Krien et al.
2007/0200397 A1 8/2007 Jackson et al.
2007/0265144 A1 * 11/2007 Jackson ..... A47D 13/04 482/68
2012/0287226 A1 * 11/2012 Baloga ..... A47B 83/04 348/14.08
2015/0035321 A1 * 2/2015 Lee ..... A47D 13/04 297/5
2015/0265049 A1 9/2015 Azumi et al.
2018/0317668 A1 * 11/2018 Cotirla ..... A47D 3/001
2019/0125070 A1 * 5/2019 Summerville ..... A47B 13/088

* cited by examiner

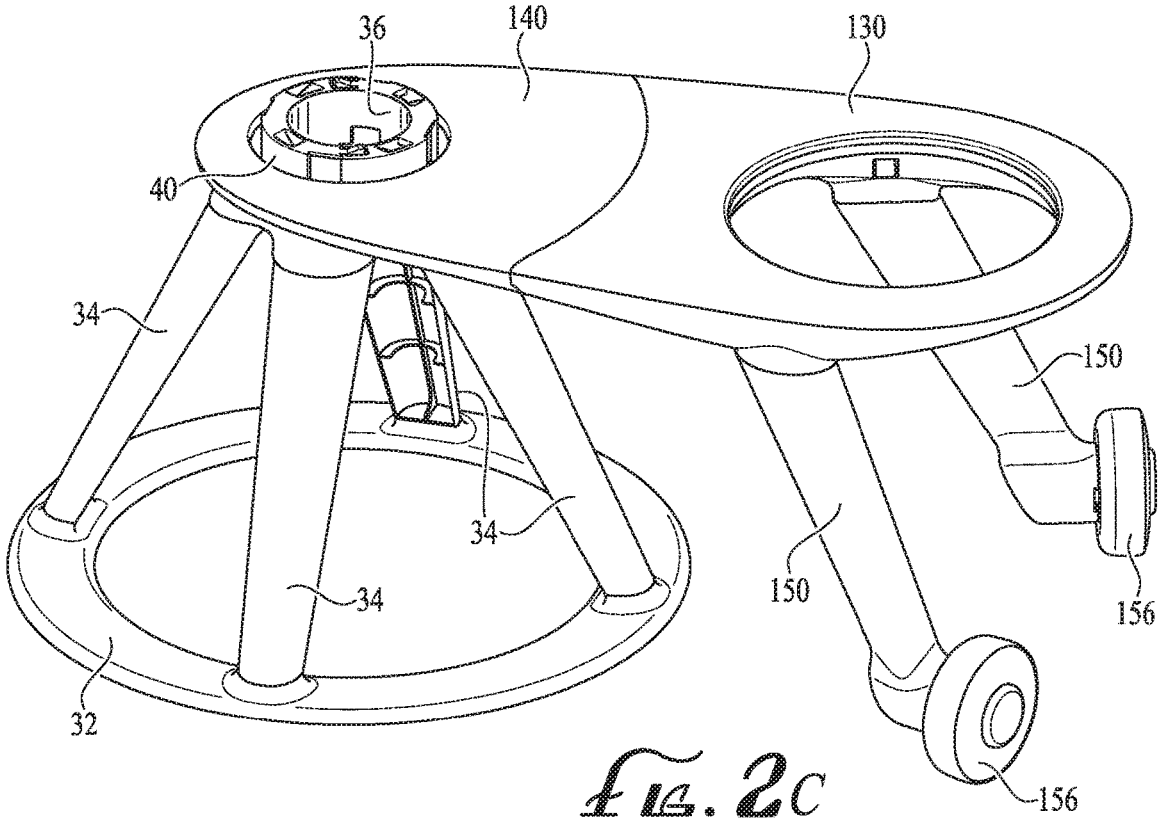
FIG. 2C
FIG. 3A
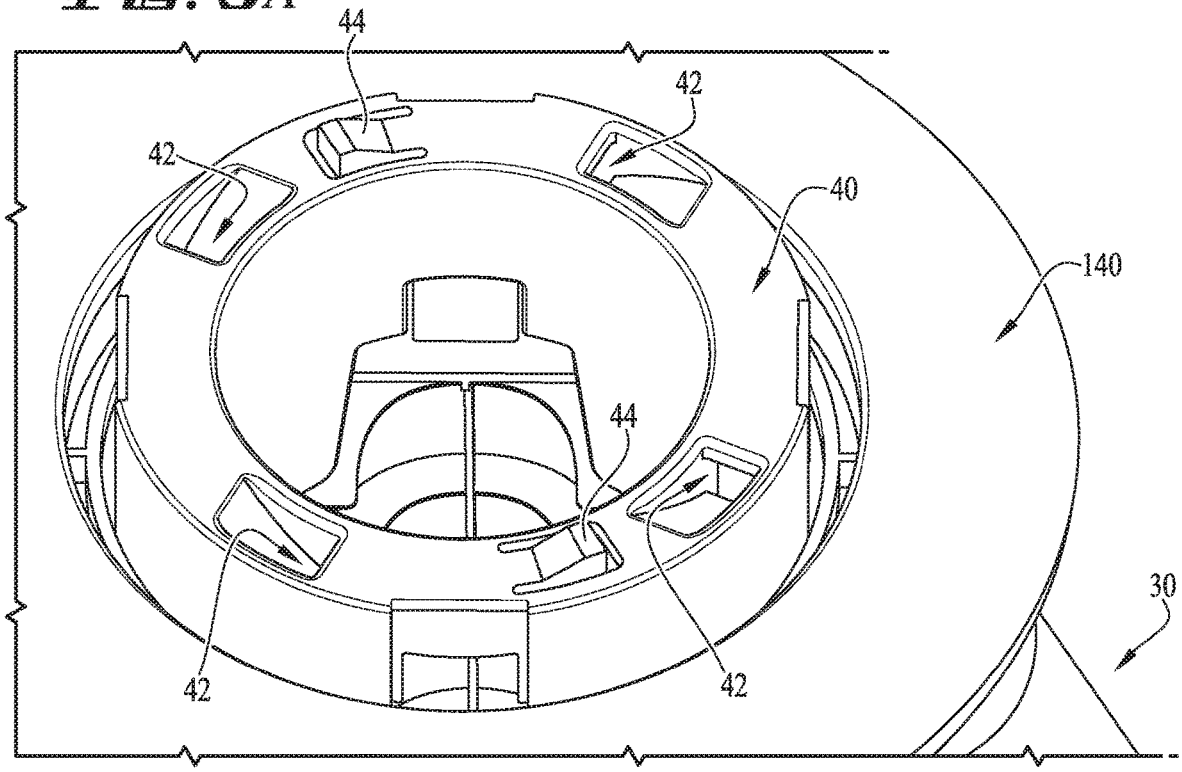

MODULAR TABLE AND WALKER

CROSS-REFERENCE TO RELATED APPLICATION

This application claims the benefit of U.S. Provisional Patent Application Ser. No. 62/732,978 filed Sep. 18, 2018, the entirety of which is hereby incorporated herein by reference for all purposes.

TECHNICAL FIELD

The present disclosure relates generally to the field of children's products and accessories, such as walkers and play tables, and to modular furniture and equipment.

BACKGROUND

As children grow, their gear and toys must change to help the child develop their physical and cognitive skills. Walkers provide children with assistance developing muscle coordination used for walking while play tables provide cognitive developmental activities for a child. While walkers coupled to play tables have been developed, they are limited in their ability to entertain and stimulate the child as the child grows.

Typical accessories and furniture such as children's play tables may include toys and other interactive or play features but may not be adaptable for different uses or for different stages of child development. For example, toys and accessories that entertained a child as an infant or young toddler may no longer be of interest to an older toddler or preschooler. As a result, accessories and furniture are often disposed of and replaced as a user's needs or activities change, which may be considered economically wasteful or environmentally unfriendly.

Accordingly, it can be seen that needs exist for improvements in children's accessories and furniture, such as play tables and walkers. It is to the provision of solutions meeting these and other needs that the present disclosure is primarily directed.

SUMMARY

In example embodiments, the present disclosure provides a children's play table having an orbital walker removably coupled for rotational movement about the table. In further embodiments, the present disclosure provides a children's play table or other furniture item or accessory having interchangeable modular table accessory panels or table leaves that allow a user to adapt the product to different applications or stages of childhood development.

In one aspect, the disclosure relates to a children's play table and walker. The play table and walker preferably include a play table portion including a table base, a mounting hub supported by the table base, a support panel configured for attachment to the mounting hub, and a plurality of modular table accessory panels configured for interchangeable coupling with the support panel. The play table and walker preferably also include a walker portion including a seat portion having a seat for supporting a child therein, a connecting portion extending from the seat platform and configured for rotational coupling with the play table portion, and at least one walker support leg having a proximal end attached to the seat platform and a distal end comprising a wheel.

In another aspect, the disclosure relates to a table including a table base and a tabletop assembly configured for attachment to the table base. The tabletop assembly preferably includes a plurality of modular table accessory panels configured for detachable and interchangeable connection with the table base.

In still another aspect, the disclosure relates to a table including a table base and a tabletop assembly configured for attachment to the table base. The table base preferably includes a mounting hub having recessed receivers with downwardly inclined contact surfaces. The tabletop assembly preferably includes guidance members configured to align with the recessed receivers and move along the downwardly inclined sliding contact surfaces to provide gravity-assisted connection of the tabletop assembly to the table base.

In another aspect, the invention relates to a kit including a plurality of components for modular assembly into at least two different product configurations. The components are preferably selected from a component group including base support components, tabletop components, and walker components. The product configurations are preferably selected from a product configuration group including a children's walker product configuration and a children's play table product configuration.

These and other aspects, features and advantages of the disclosure will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments, and are not restrictive of the invention, as claimed.

BRIEF DESCRIPTION OF THE DRAWINGS

FIGS. 2A, 2B and 2C show a sequence of assembly of a seat platform and connecting panel onto a base pedestal of the play table and walker of FIG. 1.

FIGS. 3A, 3B, 3C, 3D, 3E, 3F and 3G show details of the connection of a table-top support panel to the base pedestal of the play table and walker of FIG. 1.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that the invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
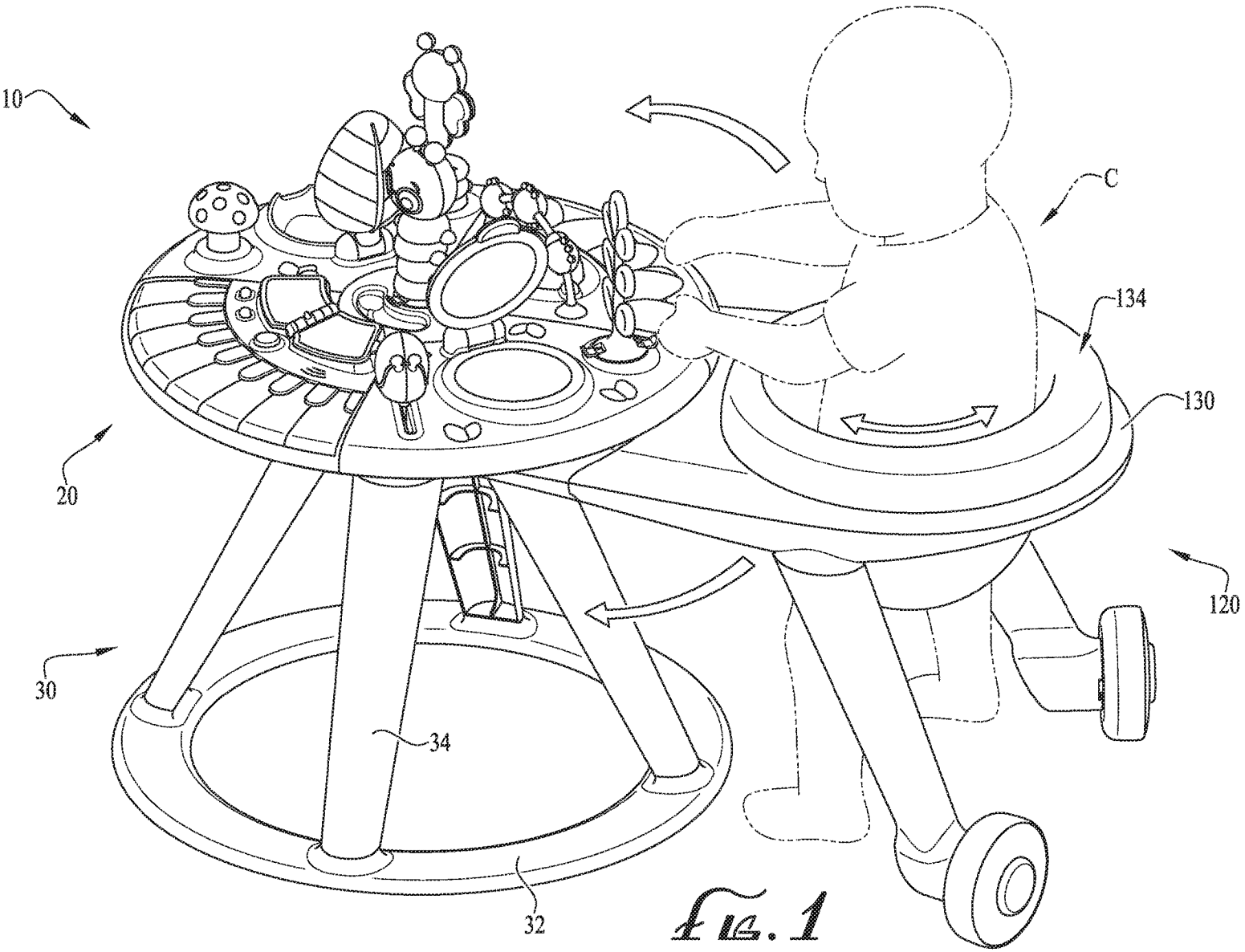
FIG. 1 is a perspective view of a play table having a modular tabletop assembly and an orbital walker according to an example embodiment of the present disclosure.

With reference now to the drawing figures, FIG. 1 shows a children's accessory or play apparatus 10 comprising a play table 20 and an orbital walker 120. In the depicted configuration, the walker 120 is rotationally coupled to the table 20, to allow a child C seated in the walker to move in a generally circular orbital path (as indicated by the directional arrows) around the circumference of the table. U.S. Pat. No. 7,507,162 is incorporated by reference herein for background information. The play table 20 optionally includes a variety of play accessories coupled to and/or supported on its top surface for child interaction. In example embodiments, the play table 20 includes one or more modular or interchangeable accessory panels or segments, as described in greater detail herein, allowing the table and accessory format to be changed out for a variety of interactive play experiences or applications, and/or to update the table with age and development stage appropriate features as the child grows and learns. Optionally, the walker portion 120 is removable, allowing the table 20 to be used independently when the child no longer requires the walker for support.

As seen best with reference to FIGS. 1 and 2C, in the example embodiment depicted, the play table portion 20 of play apparatus 10 comprises a base pedestal 30 comprising a generally planar support ring or panel 32 configured to rest on the floor or other support surface, and a plurality (four in the depicted embodiment) of table support legs or struts extending generally upwardly and inwardly at an obliquely inclined angle from lower ends coupled to the support ring to upper ends coupled to a central mounting hub 36. In alternate embodiments, the support panel may be otherwise configured or omitted, and/or one or more table support members may be provided. The mounting hub 36 includes a generally horizontal annular bearing surface or support flange 38 projecting radially outwardly and circumferentially around a generally cylindrical and upwardly extending collar or sleeve 40, seen best in FIGS. 4D and 4E, for supporting and attaching the orbital walker portion 120 when assembled, as further described below.

Figure 2A:
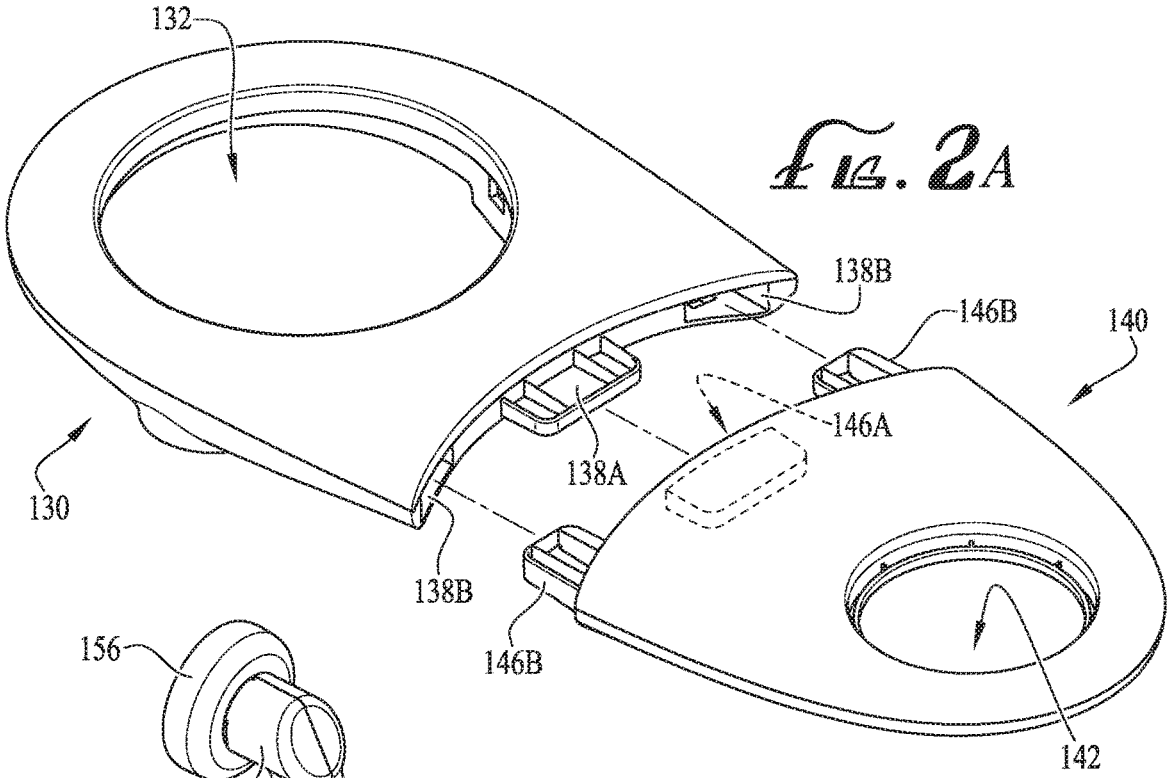
Figure 2B:
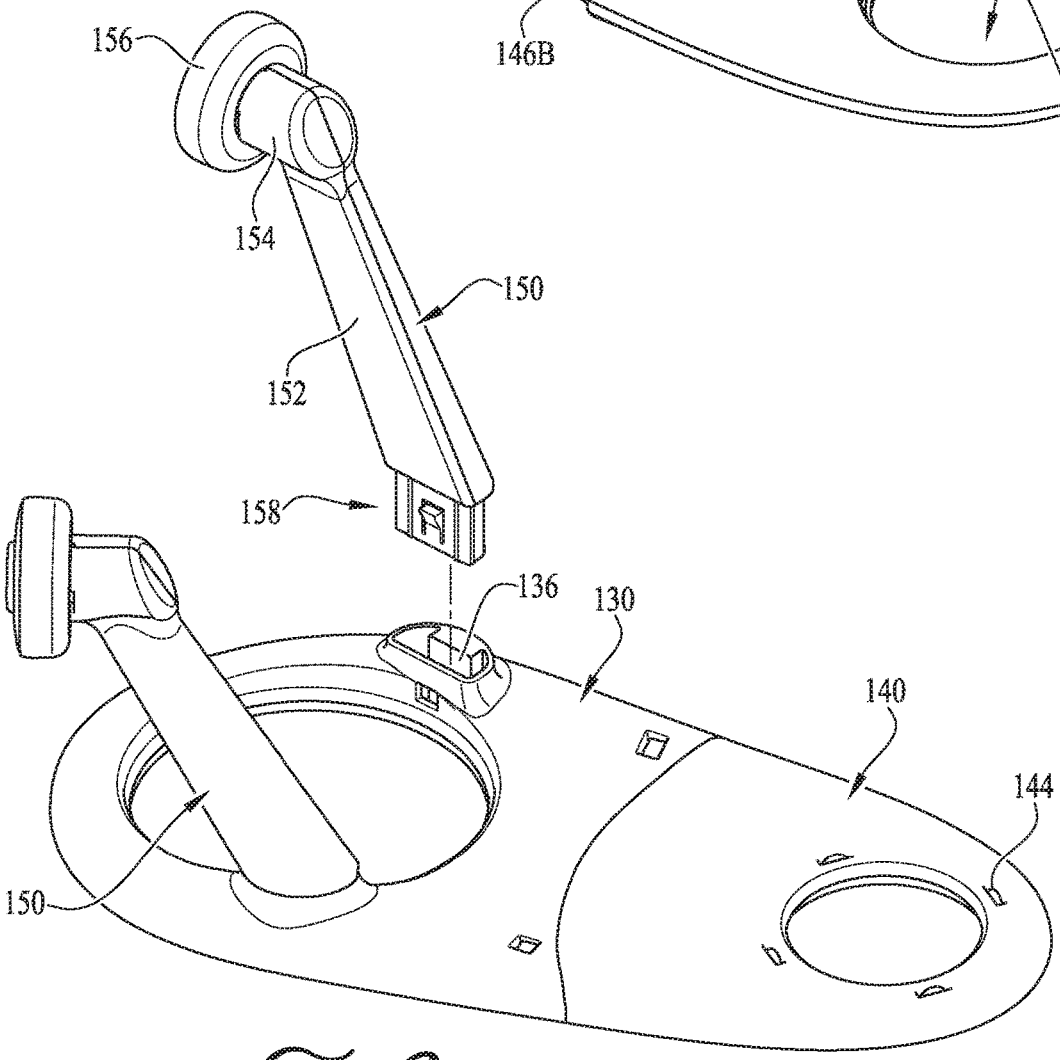

FIGS. 2A, 2B and 2C show further details and a sequence of assembly of the orbital walker portion 120 of the apparatus 10. The walker 120 generally comprises a seat platform 130, a connecting panel 140, and one or more (two are depicted) walker support legs or struts 150. The seat platform 130 defines a generally circular seat opening 132 for receiving and supporting a child seat 134 (for example a rotationally mounted roller-bearing supported ring with a fabric seat sling suspended therefrom), leg receiver couplings 136 on a bottom surface thereof, and male and/or female snap coupling flanges and/or receivers 138A, 138B on a distal end thereof. In example embodiments, the sling of the seat 134 may be fabric that is easily removable and cleanable. Alternatively, the seat 134 may comprise a flexible or rigid material such as plastic. The connecting panel 140 defines a generally circular support pedestal opening 142, with one or more (four are depicted) roller or wheel bearings 144 on a bottom surface thereof spaced circumferentially around the pedestal opening, and female and/or male snap coupling receivers and/or flanges 146A, 146B. The walker support legs 150 include an elongate strut or body portion 152, a lower bearing hub 154 at a distal end supporting a roller or wheel 156, and an upper connecting hub 158 for snap-coupling engagement with the leg receiver couplings 136 of the seat platform 130.

The walker portion 120 is assembled as shown in FIGS. 2A-2C by pressing the seat platform 130 and connecting panel 140 together to cooperatively engage the male and/or female snap coupling flanges and/or receivers 138A, 138B of the seat platform 130 with the female and/or male snap coupling receivers and/or flanges 146A, 146B of the connecting panel 140 to form a substantially rigid assembly (FIG. 2A). Alternatively, the seat platform 130 and connecting panel 140 may be integrally formed as a unitary component and not require assembly. The upper connecting hubs 158 of the walker support legs 150 are pressed into coupling engagement with the leg receiver couplings 136 of the seat platform 130 (FIG. 2B). Alternatively, the seat platform 130 and walker support legs 150 may be integrally formed as a unitary component and not require assembly. In example embodiments, the walker and seat assembly can be disassembled for easy transport and storage. For example, the legs 150 and the connecting portion 140 can be removed from the seat support 130 in order to fit into a smaller packing cube for improved and environmentally friendly packaging and economical shipping.

The support pedestal opening 142 of the connecting panel 140 is mounted over the upwardly extending collar 40 of the mounting hub 36 of base pedestal 30 of the table 20, with the roller bearings 144 of the connecting panel supported on the bearing surface of support flange 38 of the mounting hub of the table base pedestal (FIG. 2C). The walker portion 120 is then configured for orbital revolution or rotation about the table portion 20, with the wheels 156 rolling on the floor or other support surface at an outer end of the walker portion, and the roller bearings 144 rolling on the bearing surface of support flange 38 at an inner end of the walker portion, as the child supported therebetween in the seat 134 walks the walker around the stationary play table. As seen in FIGS. 1 and 2C, the wheels 156 on the walker support legs 150 may be angularly offset to generally match the radius of curvature of their circumferential path of motion, with rotational axes of the wheels extending substantially radially along a directional line that would intersect a vertical centerline or axis of rotation of the walker around the table, for a smoother rolling movement as the walker 120 revolves around the table 20. The walker portion 120 may alternatively be removed for use of the table portion 20 independently.

As shown in FIGS. 3A-3G, the upwardly extending collar 40 of the mounting hub 36 of base pedestal 30 includes one or more, and preferably a plurality of inwardly or downwardly recessed receivers 42 having obliquely and downwardly inclined or ramped sliding contact surfaces for gravity-assisted attachment of the tabletop, as described in greater detail below. In the depicted embodiment, four downwardly inclined recesses 42 are spaced substantially equally apart around the circumference of the upper surface of the collar 40 of the mounting hub 36, with the slopes of their downwardly inclined or ramped sliding contact surfaces all aligned or directed in the same rotational direction. In example embodiments, when viewed from above, the recesses 42 define a semi-circular or arcuately curved path corresponding to path of rotational motion about a vertical axis extending through the center of the mounting hub. The upper surface of the collar 40 also includes one or more upwardly projecting and resiliently flexing locking tabs or latches 44, having obliquely and upwardly inclined or ramped contact surfaces for retaining the tabletop, as described below. In the depicted embodiment, two upwardly inclined locking tabs 44 are positioned diametrically opposite one another and spaced circumferentially between adjacent downwardly inclined recesses. The slopes of the upwardly inclined ramped surfaces of the locking tabs 44 are aligned or directed in the same rotational direction as the downwardly inclined ramped surfaces of the recesses 42.

The table 20 further comprises a table-top support panel 50, configured for removable attachment to the upwardly extending collar 40 of the mounting hub 36 of base pedestal 30, and for interchangeable attachment of one or more interchangeable table leaves or modular table accessory panels thereto. In the depicted embodiment, the support panel 50 comprises a generally circular or disc shaped panel having a top surface, a bottom surface, a circumferential peripheral edge, and a central connection hub 54 for engagement with the upwardly extending collar 40 of the table's base pedestal 30. In alternate embodiments, the table-top support panel may be rectangular, square, triangular, polygonal, or otherwise configured. The connection hub 54 optionally includes a lower annular flange 56 projecting transversely downward from the bottom surface of the support panel 50 that fits within the circular opening 142 of the connecting panel 140 and/or around the collar 40 of the table pedestal 30 when assembled. The connection hub 54 also includes an upper annular collar or flange 58 projecting transversely upward from the top surface of the support panel for engagement with the modular table accessory panels as described below. One or more semi-circular or otherwise shaped sockets 60 are spaced circumferentially about the upper annular collar 58 for engagement with cooperating engagement elements of the modular table accessory panels. One or more lower engagement recesses 62 are formed in the bottom surface of the support panel 50 along the peripheral edge, and one or more upper engagement slots 64 are formed in the top surface of the support panel along the peripheral edge, for coupling with cooperating elements of the modular table accessory panels.

The central connection hub 54 of the table-top support panel 50 further comprises at least one, and preferably a plurality of rotational guidance members or fingers 66 projecting downwardly from the bottom surface of the table-top support panel 50. In the depicted embodiment, four downwardly projecting guidance fingers 66 are spaced substantially equally apart around the circumference of the bottom surface of the central connection hub 54. The guidance fingers 66 optionally comprise an obliquely inclined or ramped upper or top contact surface, and a generally parallel obliquely inclined or ramped lower or bottom contact surface configured to generally align with and slide smoothly along the confronting inclined contact surfaces of the downwardly recessed receivers 42 in the top of the collar 40 of the mounting hub 36 of base pedestal 30, for rotational gravity-assisted attachment of the table-top support panel 50 to the base pedestal.

Figure 3B:
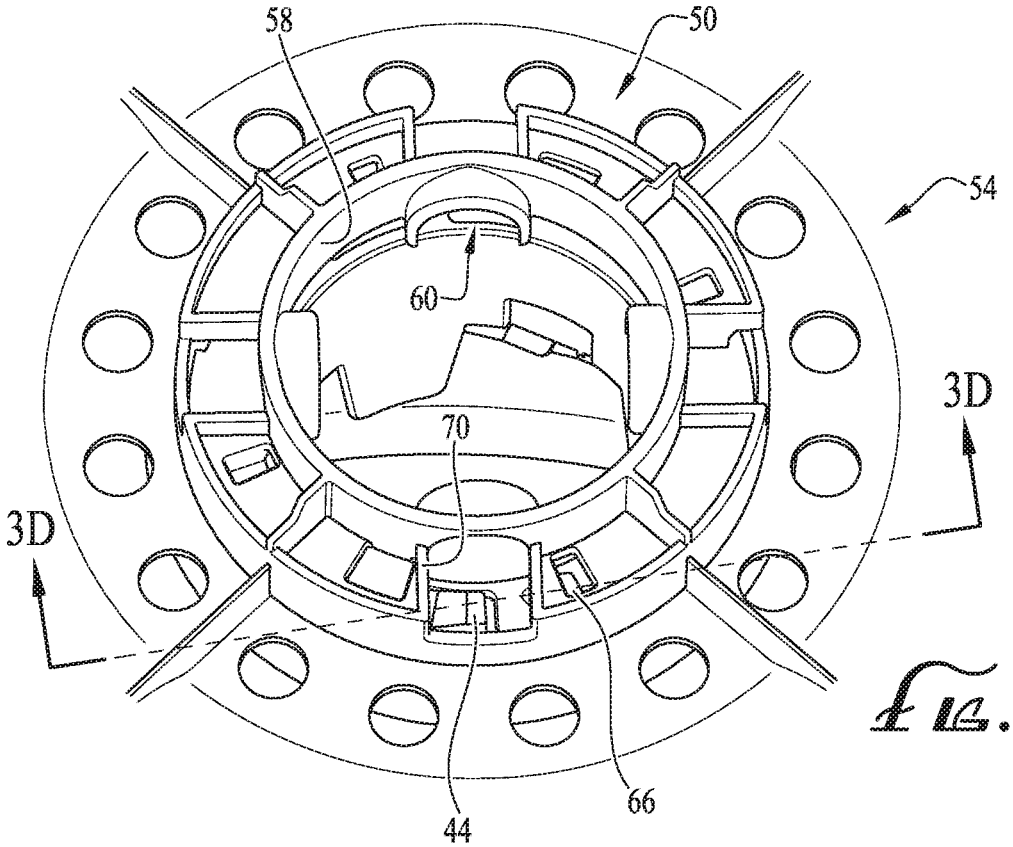
Figure 3C:
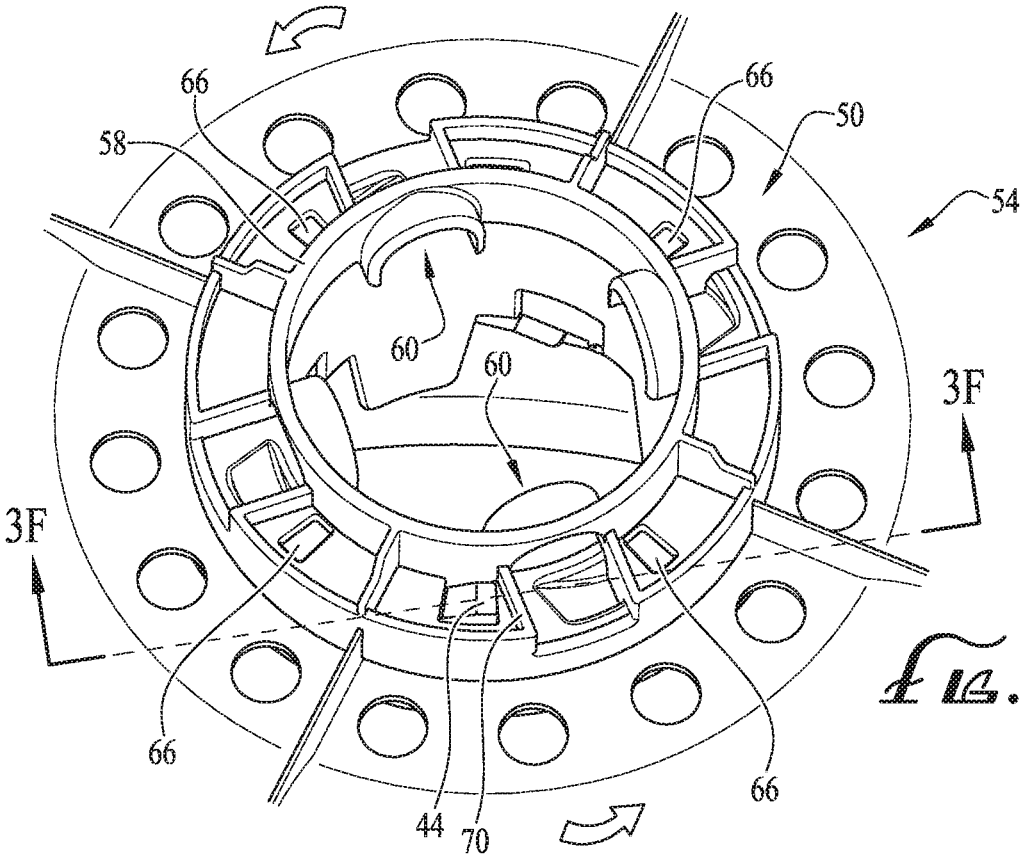
Figure 3D:
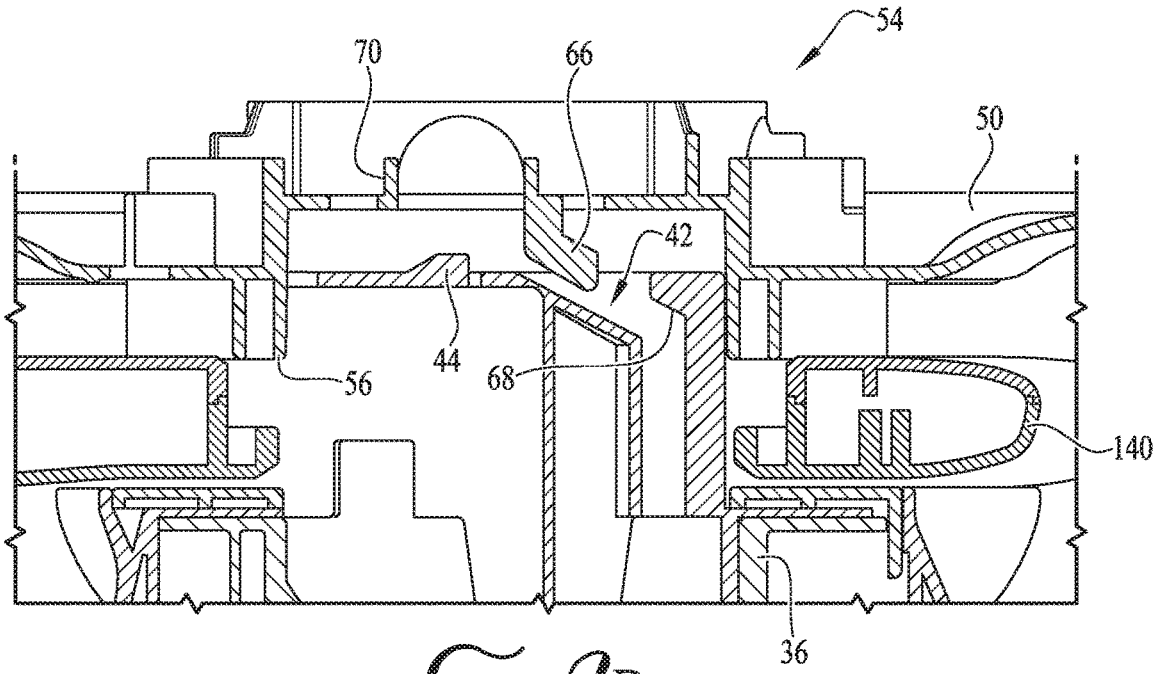
Figure 3E:
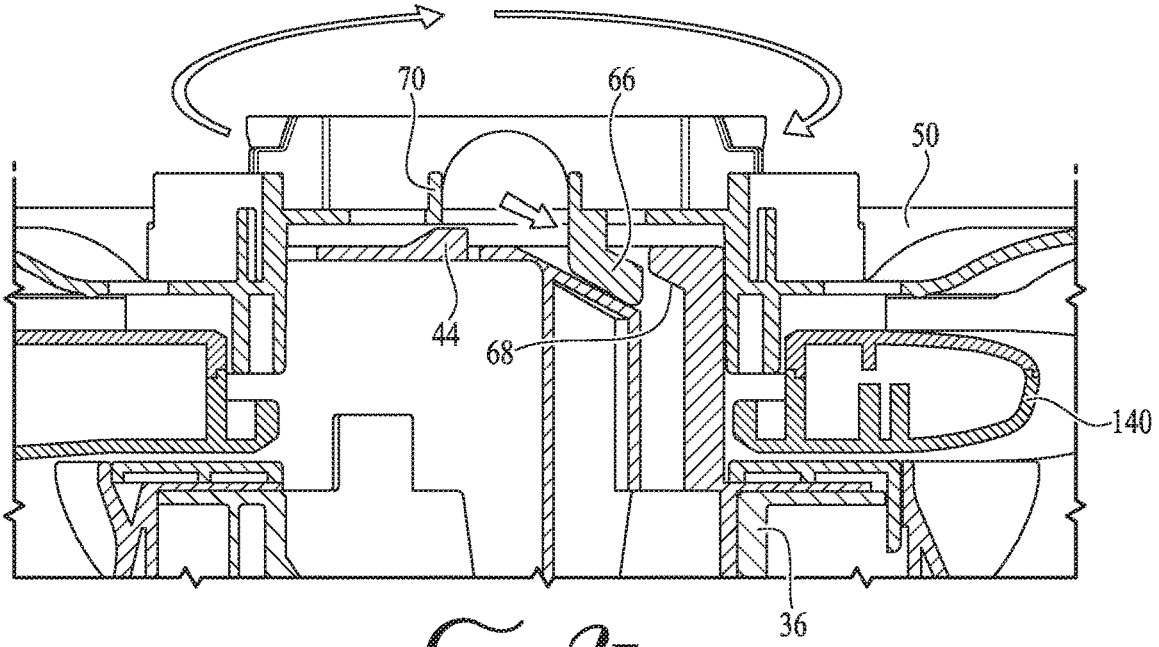

FIGS. 3B-3G show a sequence of assembly for installation and attachment of the table-top support panel 50 onto the table's base pedestal 30. The table-top support panel 50 is placed over pedestal 30 with the bottom surface of the support panel facing the top of the upwardly extending collar 40 of the mounting hub 36, with the lower annular flange 56 of the connection hub 54 extending over and around the mounting hub (FIGS. 3B and 3D). If the walker portion 120 is installed, the connecting portion 140 is positioned captive between the annular bearing flange 38 of the pedestal 30 and the central connection hub 54 of the table-top support panel 50. The table-top support panel 50 is manually rotated in a first rotational direction (for example, counter-clockwise when viewed from above) about its center axis until the guidance fingers 66 of the support panel align and drop partially into the downwardly recessed receivers 42 in the top of the collar 40 of the mounting hub 36 of base pedestal 30 (FIG. 3E). Because the mounting hub 36 of the pedestal 30 is positioned within the lower annular flange 56 of the table-top support panel 50, the support panel remains in place on the pedestal as the user rotates the support panel into position. The inclined bottom contact surfaces of the guidance fingers 66 slide smoothly downward along the confronting inclined upward facing contact surfaces of the recessed receivers 42 as the support panel 50 continues to rotate and lowers under the influence of gravity onto the pedestal 30. In this manner, the weight of the table-top support panel 50 provides a gravity assist to its installation and coupling onto the pedestal 30. In example embodiments, the opposed angles of inclination of the inclined contact surfaces of the guidance fingers 66 and the confronting inclined contact surfaces of the recessed receivers 42 are between about 20°-40°, for example about 30°.

Figure 3F:
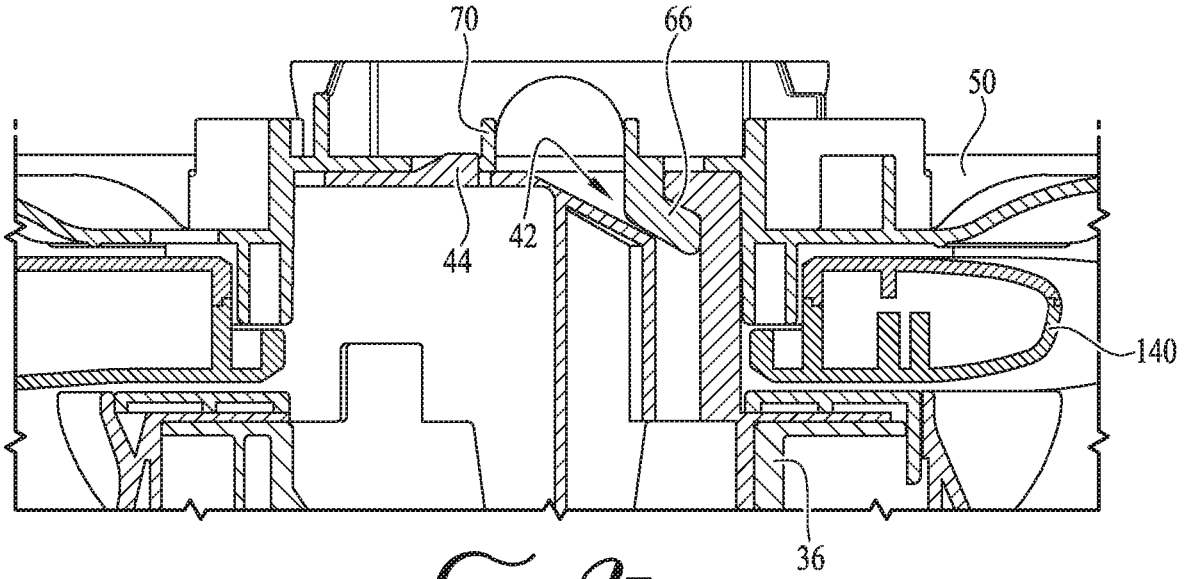
Figure 3G:
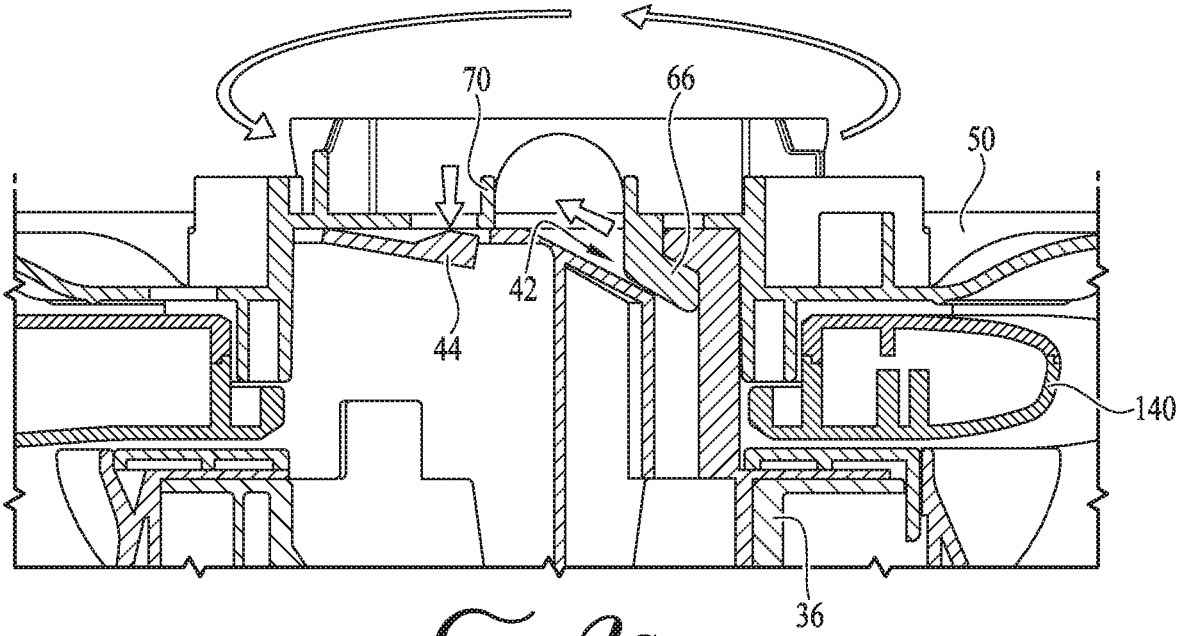

As the table-top support panel 50 rotates further in the first rotational direction relative to the pedestal 30, the inclined top surfaces of the guidance fingers 66 come into engagement with confronting downwardly facing inclined surfaces 68 bounding the recessed receivers 42 offset ahead of the receiver in the first rotational direction. Continued rotation of the support panel 50 in the first rotational direction draws the support panel further downward into engagement with the pedestal 30 as the top surfaces of the guidance fingers 66 move downwardly along the downwardly facing inclined surfaces 68 (FIGS. 3C and 3F). As the support panel is drawn further downward, one or more retention fins 70 on the connection hub 54 of the table-top support panel 50 come into contact with the upwardly facing inclined surface of a corresponding locking tab 44 of the mounting hub 36 of the pedestal 30, moving along the inclined face of the locking tab and pressing the tab resiliently downward (FIG. 3E). Continued rotation and downward movement of the support panel 50 moves the retention fin(s) 70 past the locking tab(s) 44 into a fully engaged position wherein abutment of the square end face of the locking tab against the retention fin prevents reverse rotation of the support panel in a second rotational direction (for example, clockwise when viewed from above), and engagement of the guidance fingers 66 against the downwardly facing inclined surfaces 68 prevents upward retraction of the support panel (FIGS. 3C and 3F). In this position, the table-top support panel 50 is releasably locked into engagement with the pedestal 30 of the table portion 20. To release and remove the table-top support panel 50, the user presses each locking tab 44 downwardly out of the path of the corresponding retention fin 70 and rotates the support panel in the second rotational direction to release the guidance fingers 66 from the inclined surfaces 68 (FIG. 3G). The guidance fingers retract upwardly out of the receivers 42, and the support panel 50 can be lifted away from the pedestal 30.

Figure 4A:
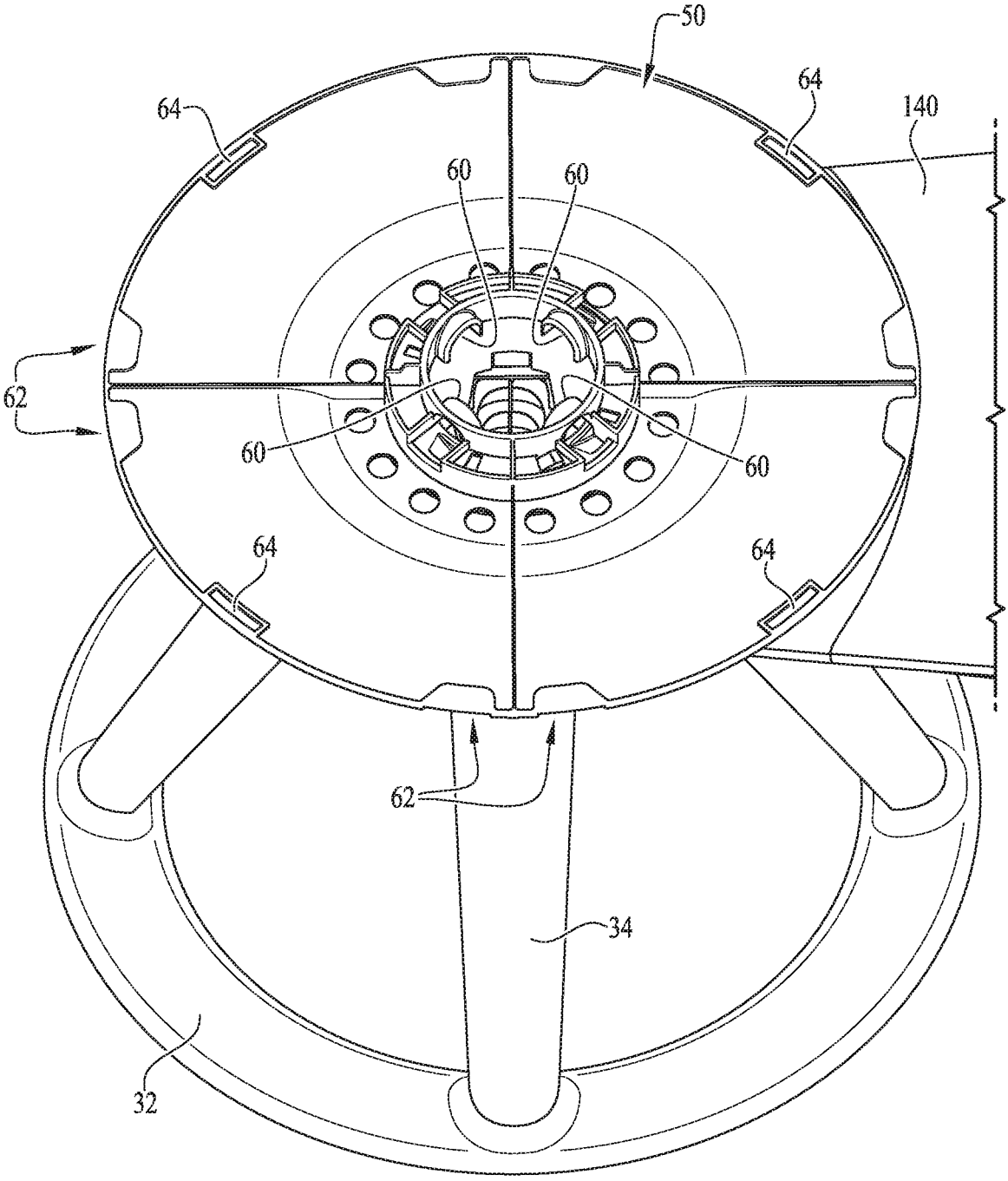
FIGS. 4A, 4B, 4C, 4D, 4E, 4F, 4G, 4H and 4I show a sequence of mounting modular table accessory panels and a coupling bracket hub onto the table-top support panel and base pedestal of the play table and walker of FIG. 1.
Figures 4B, 4C:
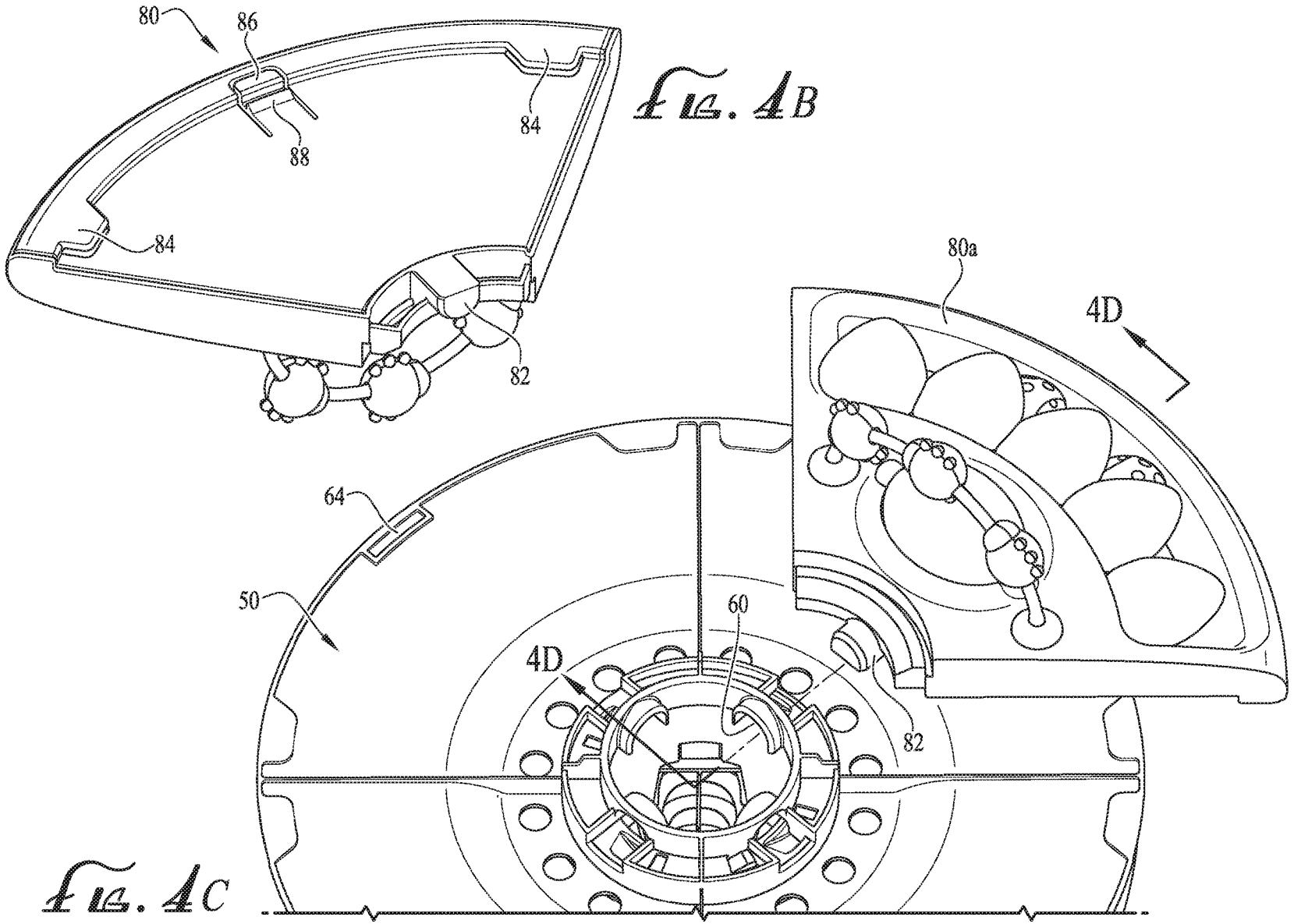
Figure 4D:
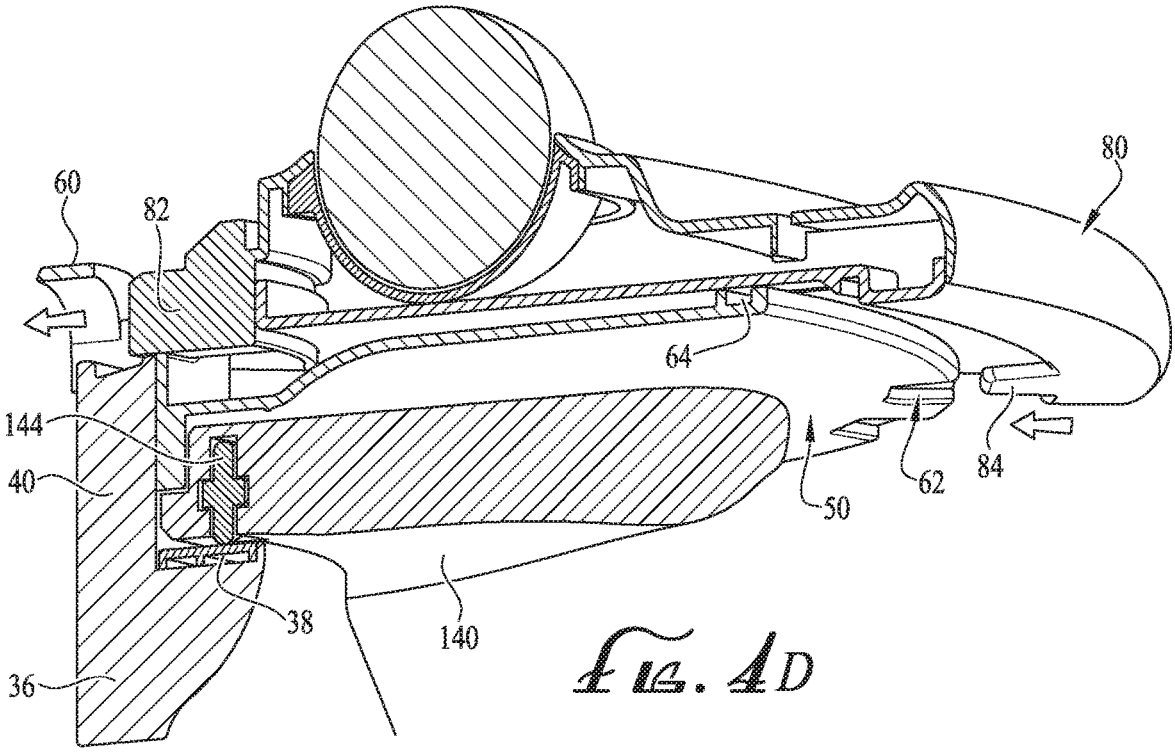
Figure 4E:
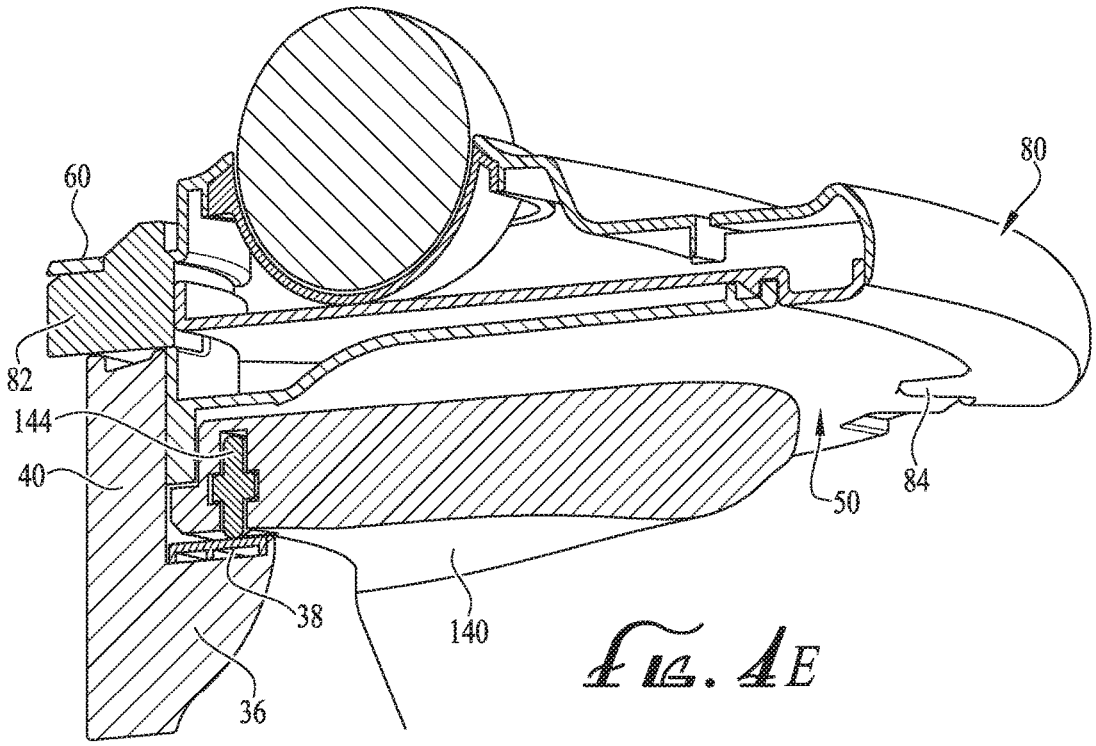
Figure 4F:
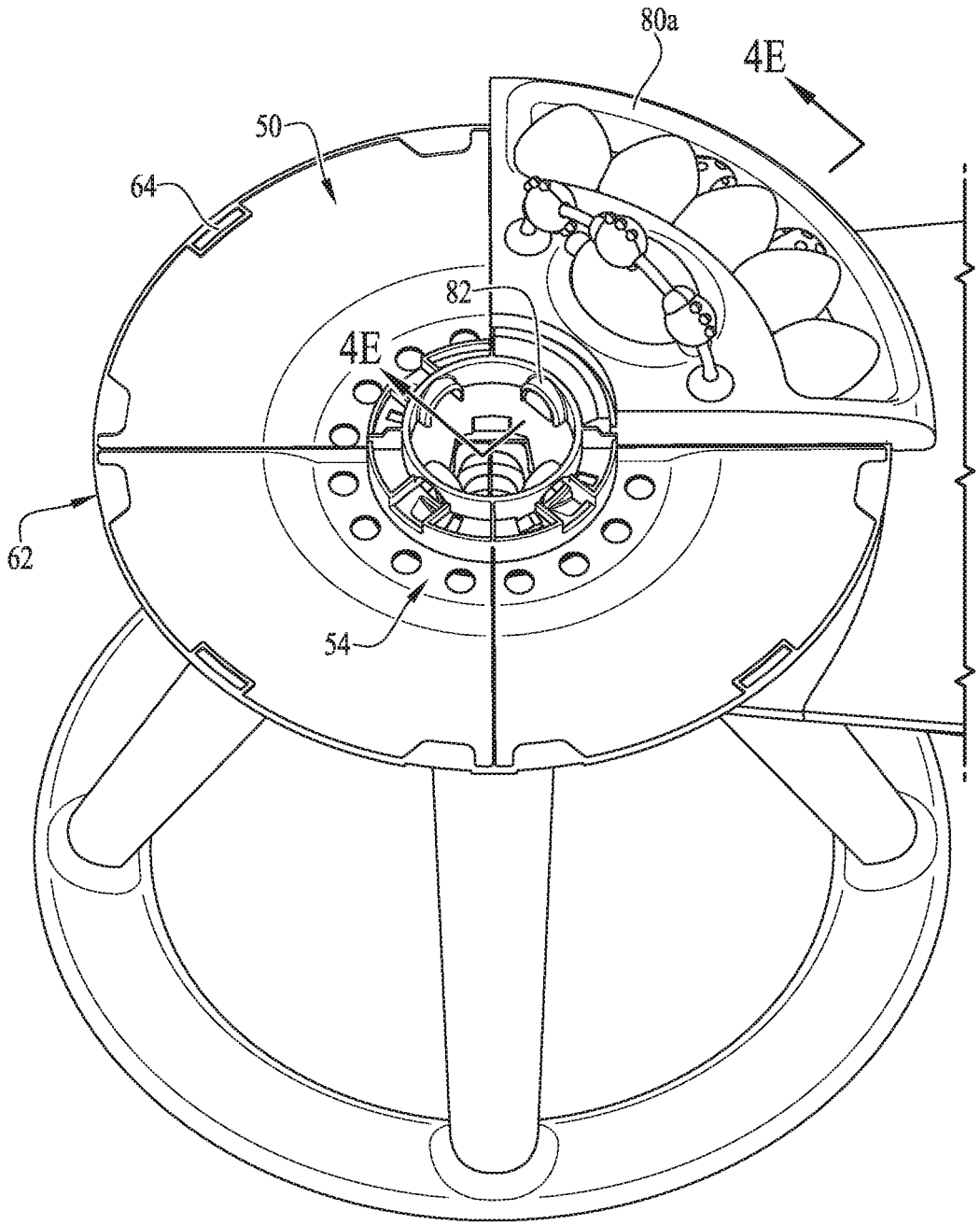
Figure 4G:
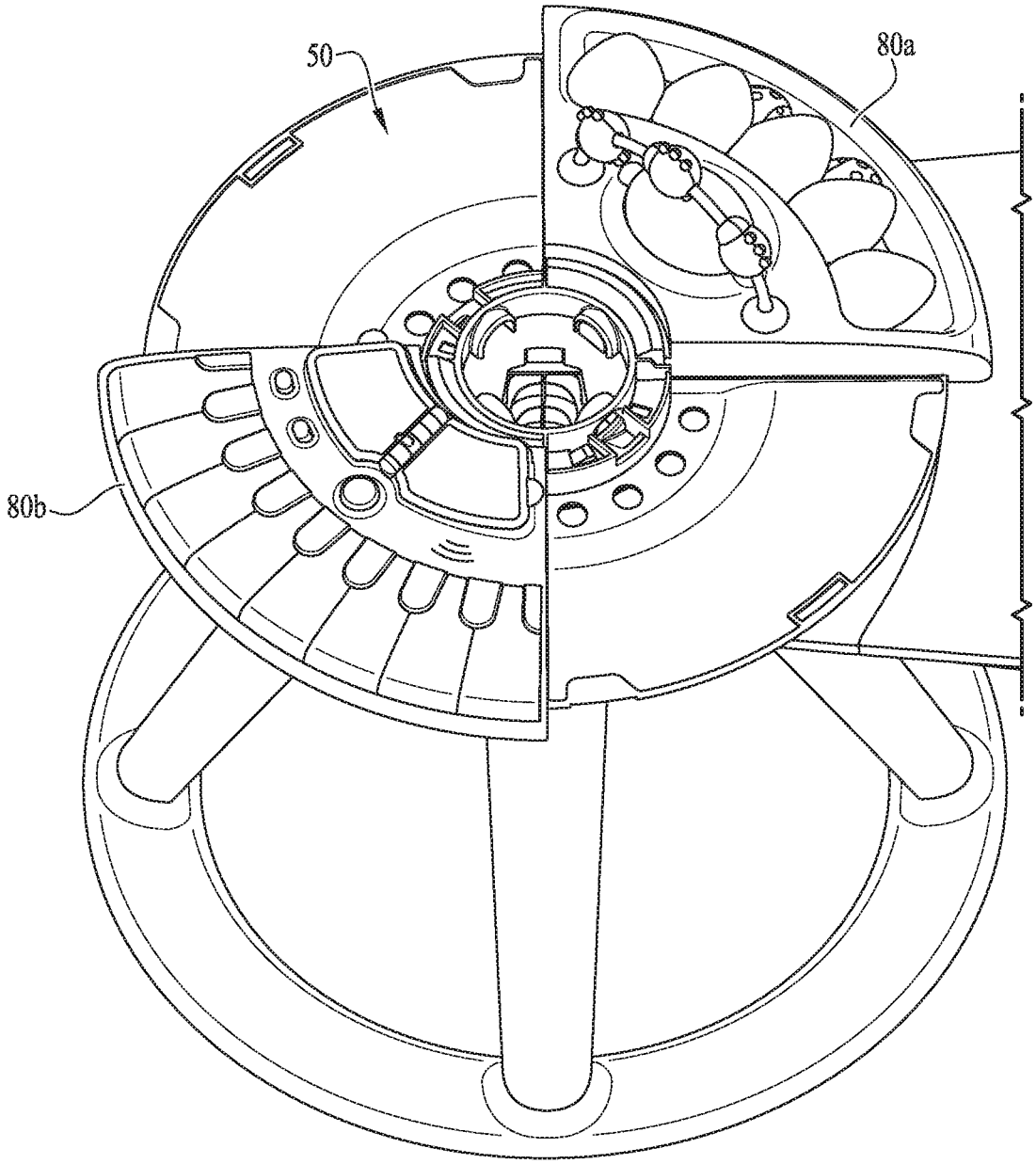
Figure 4H:
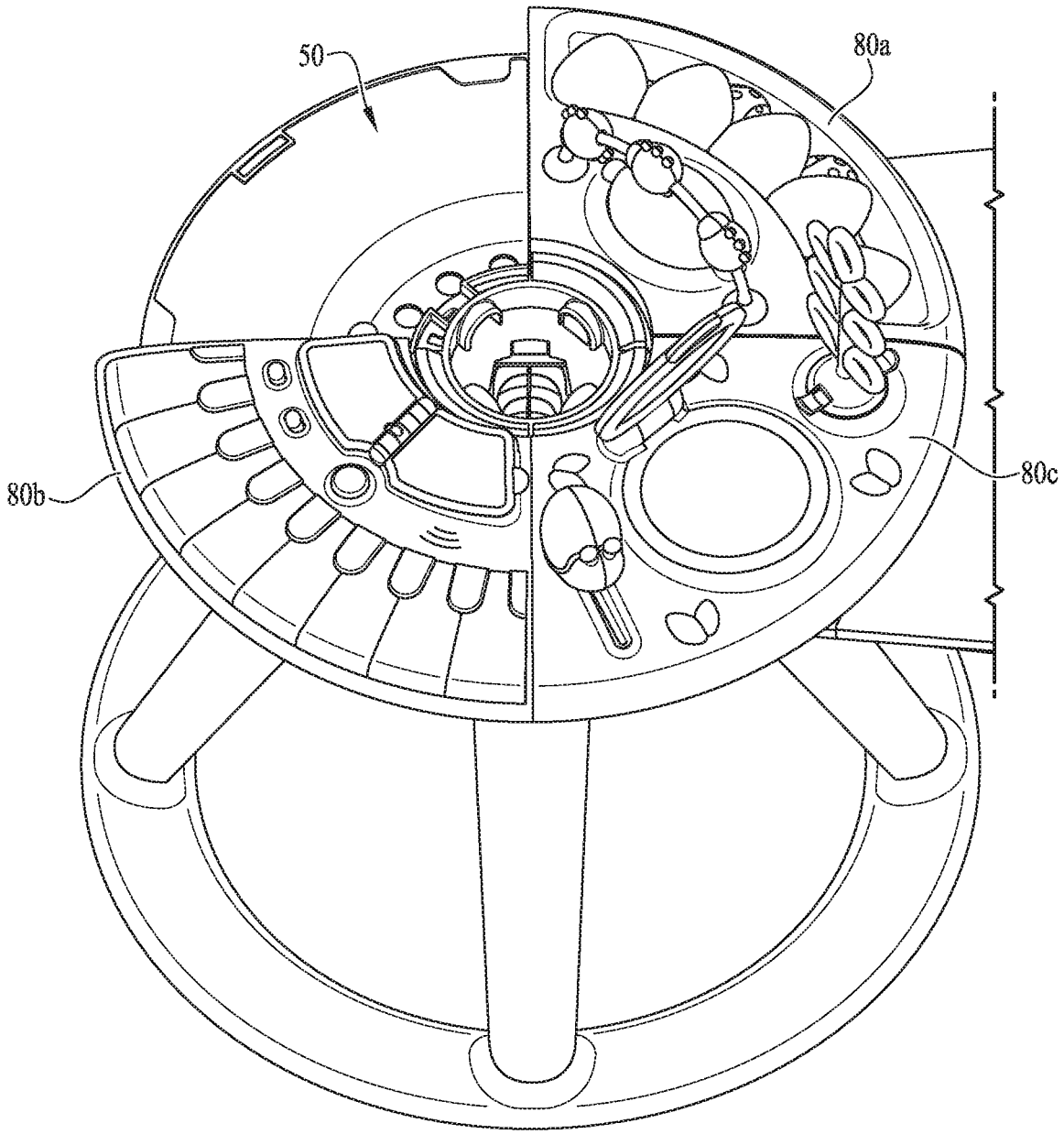
Figure 4I:
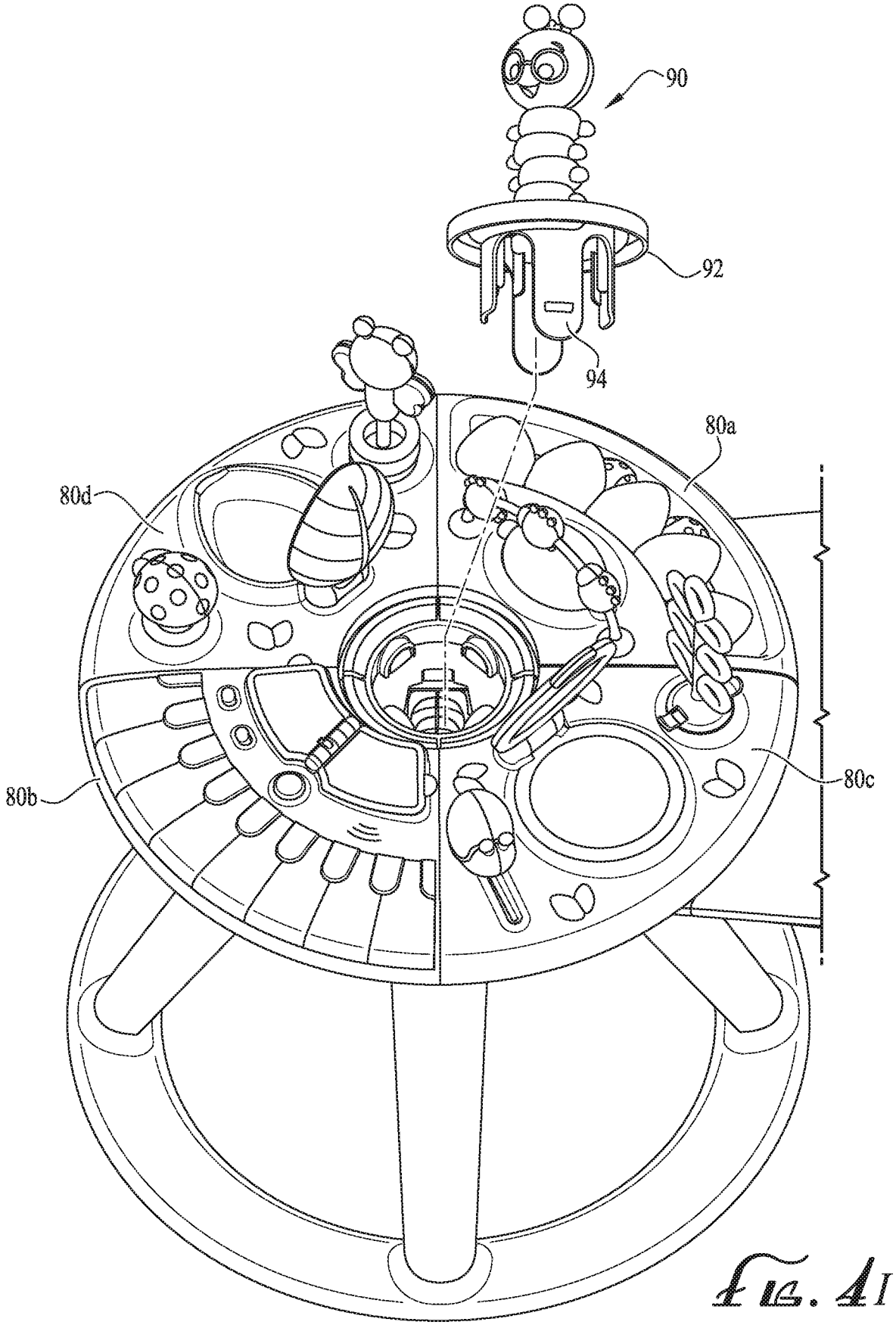

As shown in FIGS. 4A-4I, in example embodiments the table 20 further comprises one or more modular table accessory panels or table leaves 80 configured for detachable and interchangeable attachment to the table-top support panel 50. In alternate embodiments, the table-top support panel 50 may be used independently as the table surface, without separate accessory panels, and with or without one or more accessories mounted thereon. In still further alternate embodiments, the modular accessory panels may couple directly to one another to form a tabletop assembly that may be mounted to the table base without the need for a separate support panel. In the depicted embodiment, four modular table accessory panels 80*a*, 80*b*, 80*c* and 80*d* are provided, each configured to cover a one-fourth (¼) sector of the generally circular table-top support panel 50 (i.e., pie- or wedge-shaped sectors defining ¼ of a circle). Each accessory panel 80 has a top surface, a bottom surface, arcuate inner and outer peripheral edges, and first and second radial side edges. In the depicted embodiments, the arcuate inner and outer peripheral edges span 90° of the circumference of the circular assembly of the four accessory panels when assembled into place on the table-top support panel 50 as shown in FIGS. 1 and 4I. One or more interactive toys or accessories are optionally provided on the top surfaces of the accessory panels 80, for example in the form of a musical keyboard, mirror, bead-chaser, rattle, lighted accessory, character, rattle, spinner, noisemaker, puzzle, magnifier, keyboard, touch-pad, electronic display, or other features or accessories permanently affixed or detachably coupled to the panel. Alternatively, one or more of the panels 80 may have a flat surface for working, eating or other use, without accessories thereon.

Each of the modular table accessory panels 80 optionally includes one or more detachable coupling elements for detachably and interchangeably mounting the accessory panel to the support panel 50. In the depicted embodiments, a semi-circular or otherwise shaped peg or lug 82 projects radially inwardly from the arcuate inner peripheral edge of each panel 80, for cooperative detachable engagement within a corresponding arched socket 60 of the support panel 50. In the depicted embodiment, each panel 80 also includes one or more (two are shown) engagement tabs 84 directed inwardly from the outer peripheral edge along the bottom surface, for cooperative detachable engagement within a corresponding lower engagement recess 62 in the bottom surface of the support panel 50. In the depicted embodiment, each panel 80 also includes a resilient locking tab 86, for example positioned circumferentially between two adjacent engagement tabs 84, for cooperative detachable engagement with a corresponding upper engagement slot 64 in the top surface of the support panel 50. The resilient locking tab 86 may be formed by a U-shaped cutout in the bottom surface of the panel 80, such that its free end can flex resiliently inward upon application of force in a transverse direction and return back to its unflexed position under the internal bias of the material at its connected end. An abutment rib 88 extends outwardly from a medial portion of the locking tab 86.

The modular table accessory panels or leaves 80 are mounted to the table-top support panel 50 by inserting the lug 82 into a respective socket 60 and sliding the accessory panel radially inward with the bottom surface of the accessory panel sliding along the top surface of the support panel (FIG. 4D). As the accessory panel 80 moves radially inward toward its installed position, its engagement tabs 84 move into engagement with corresponding lower engagement recesses 62, thereby preventing the accessory panel from being lifted away from the support panel 50. The resilient locking tab 86 flexes inwardly as an inboard ramped surface of the abutment rib 88 passes over the peripheral rim of the upper engagement slot 64, and upon reaching the installed position of the support panel 50 the locking tab springs back moving the abutment rib into engagement within the engagement slot. An outboard square face of the abutment rib 88 of the locking tab 86 abuts against the peripheral rim of the engagement slot 64 preventing the accessory panel from being retracted away from its installed position on the table-top support panel 50.

As shown in FIGS. 4F, 4G, 4H and 4I, each of the modular table accessory panels 80*a*, 80*b*, 80*c* and 80*d* are installed and removed sequentially in like manner. While the depicted embodiment includes four accessory panels, in alternate embodiments, one, two, three, five, six or more accessory panels may be utilized, each covering a respective sector of the table-top support panel 50 in inverse proportion to the number of accessory panels. As shown in FIG. 4I, a central locking cap 90 may be provided for engagement within the opening formed by the arcuate inner peripheral edges of the accessory panels 80. The locking cap optionally includes a toy or accessory thereon. An outer circumferential flange 92 of the cap 90 may engage within a cooperating groove or channel formed in the top surface of the accessory panels, and/or one or more coupling blades 94 may extend from the cap for engagement with corresponding coupling features of the table-top support panel 50, to provide a more secure and stable assembly. To remove the accessory panels 80, the user removes the central locking cap 90 by releasing the coupling blades 94 or other engagement features and lifting the cap away from the table top assembly. The user then presses the free end of the locking tab 86 of each successive accessory panel 80 inwardly to release the abutment rib 88 from engagement with the engagement slot, retracts the accessory panel outwardly, and lifts the accessory panel away from the table-top support panel 50.

The provision of multiple interchangeable modular table accessory panels 80 allows for customization of the table 20 as the child grows and their interests and skills change. For example, one or more toys including bead chasers, electronic toys, ratchet toys, crinkle toys, spinning toys, squeakers, keyboards, musical toys, mirrors, rings, etc. may be coupled to the modular tabletop, and changed as desired to provide new and entertaining play features. In example embodiments, various sets of modular table accessory panels 80 may be separately provided, allowing a parent or caregiver to select the accessory set most appropriate for their child's interests. The modular tabletop may further comprise one or more lights or sounds for entertaining and interacting with a child. In other embodiments, the modular tabletop includes one or more accessory panels or leaves that detachably couple to each other, without including a base or support panel to which they are mounted.

The modular tabletop assembly, including the table-top support panel 50 and the modular table accessory panels 80, can be installed onto the pedestal 30 of the table 20 in its assembled state, or alternatively the support panel can be installed onto the pedestal first, and the modular accessory panels separately installed. Also, the modular tabletop assembly can be installed onto the pedestal 30 of the table 20 with or without the walker portion 120 being installed. In this manner, the table 20 can be used independently or as part of an orbital walker. Likewise, the modular accessory panels may be omitted, and example embodiments may include a table having a unitary or standard tabletop or support surface in combination with a gravity-assisted mounting system as disclosed for attachment onto a table pedestal or base.

Figure 5A:
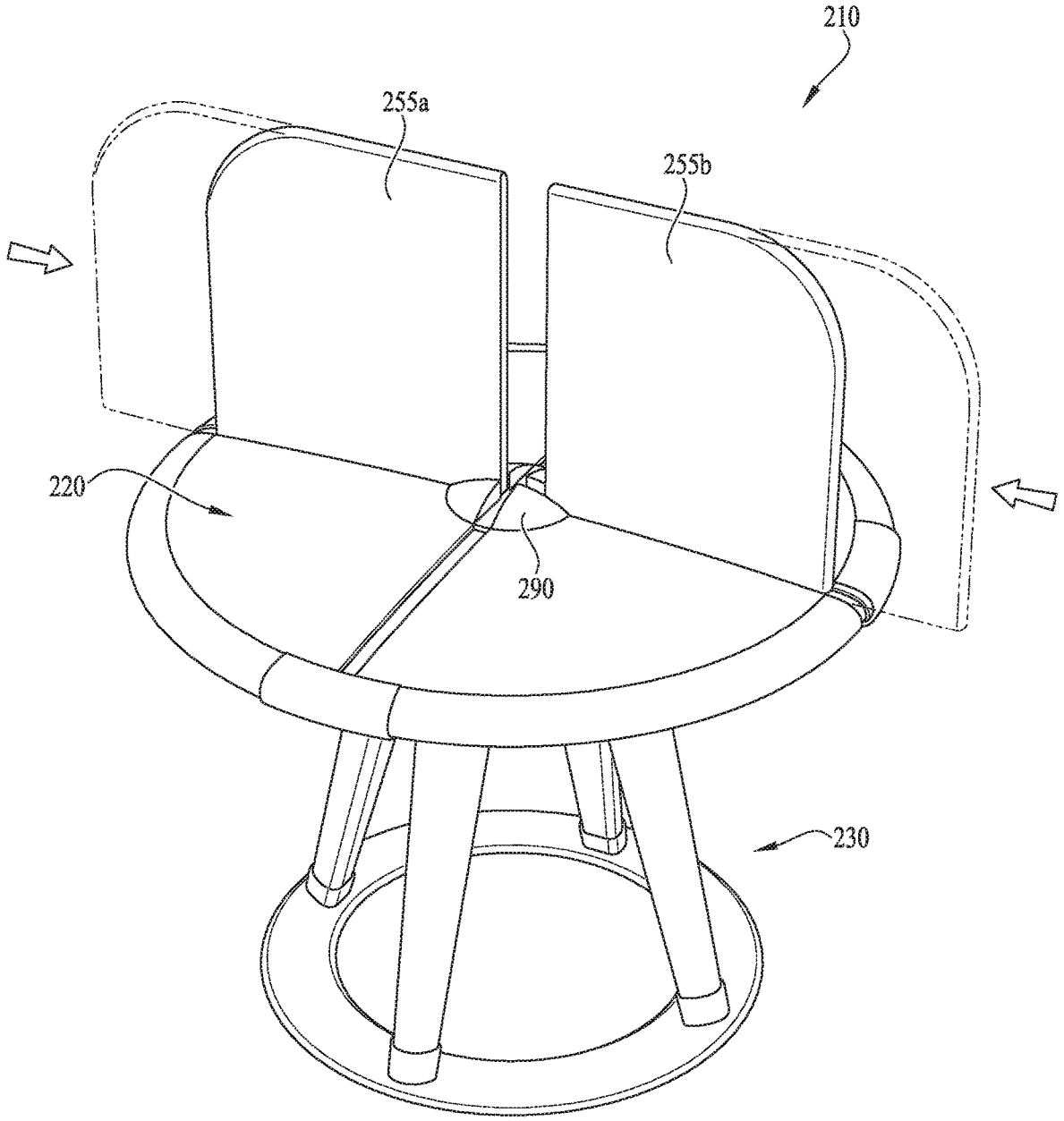
FIGS. 5A, 5B and 5C show a modular play table according to another example embodiment of the present disclosure.
Figure 5B:
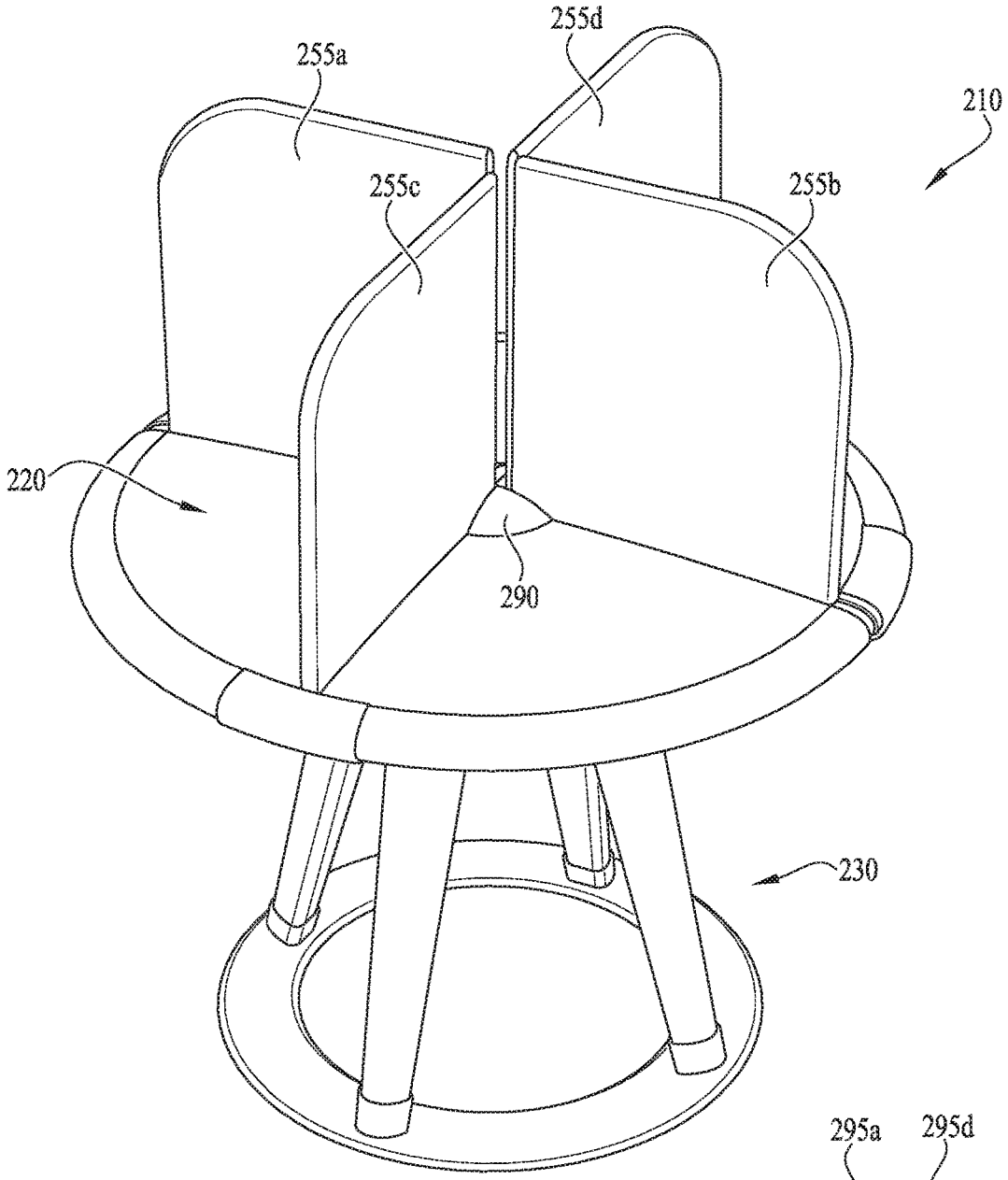
Figure 5C:
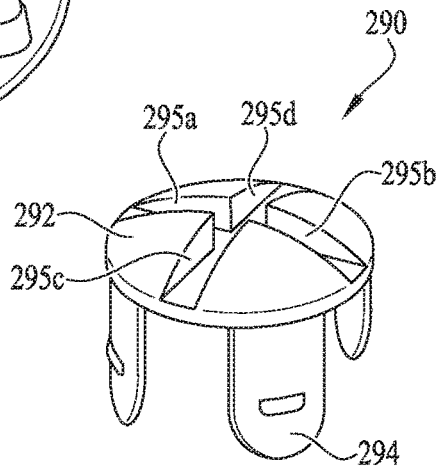

FIGS. 5A, 5B and 5C show a modular play table 210 according to another example embodiment of the present disclosure. Table 210 is generally similar to the above-described embodiments, with differences as noted. The table 210 generally comprises a tabletop portion 220 supported above a base portion 230. The central locking cap or hub 290 includes a raised top surface 292 and optionally includes one or more coupling blades or attachment flanges 294 extending from an opposite bottom surface. The raised top surface 292 may be rounded or radiused, and defines one or more slots 295 formed therein, for receiving one or more vertical divider panels 255 supported in an upright position on top of the tabletop 220. For example, in the depicted embodiment, the center cap 290 defines four slots 295*a*, 295*b*, 295*c* and 295*d* arranged in crosswise form spaced at about 90° from one another, into which one or more vertical panels 255*a*, 255*b*, 255*c* and 255*d* may be retained. The lower edges of the panels 255 are configured to fit within the slots 295 with a running or sliding fit, so that a child or adult caregiver can easily install and remove the panels by hand to reconfigure the table 210 as desired. Optionally, the panels 255 may include one or more toys or other entertainment or interactivity features or elements attached thereto or integrally formed therewith. Optionally, the tabletop 220 includes one or more additional slots or retainer elements, for example around the periphery of the tabletop, for providing additional support and retention of the panels 255 in place on the tabletop. One, two (FIG. 5A), three, or four (FIG. 5B) panels 255 may be installed, depending on the desired table configuration and use. In alternate embodiments, the center cap 290 defines one, two, three, four, five, six or more slots, to retain up to a like number of divider panels on the tabletop in similar fashion.

Figure 6A:
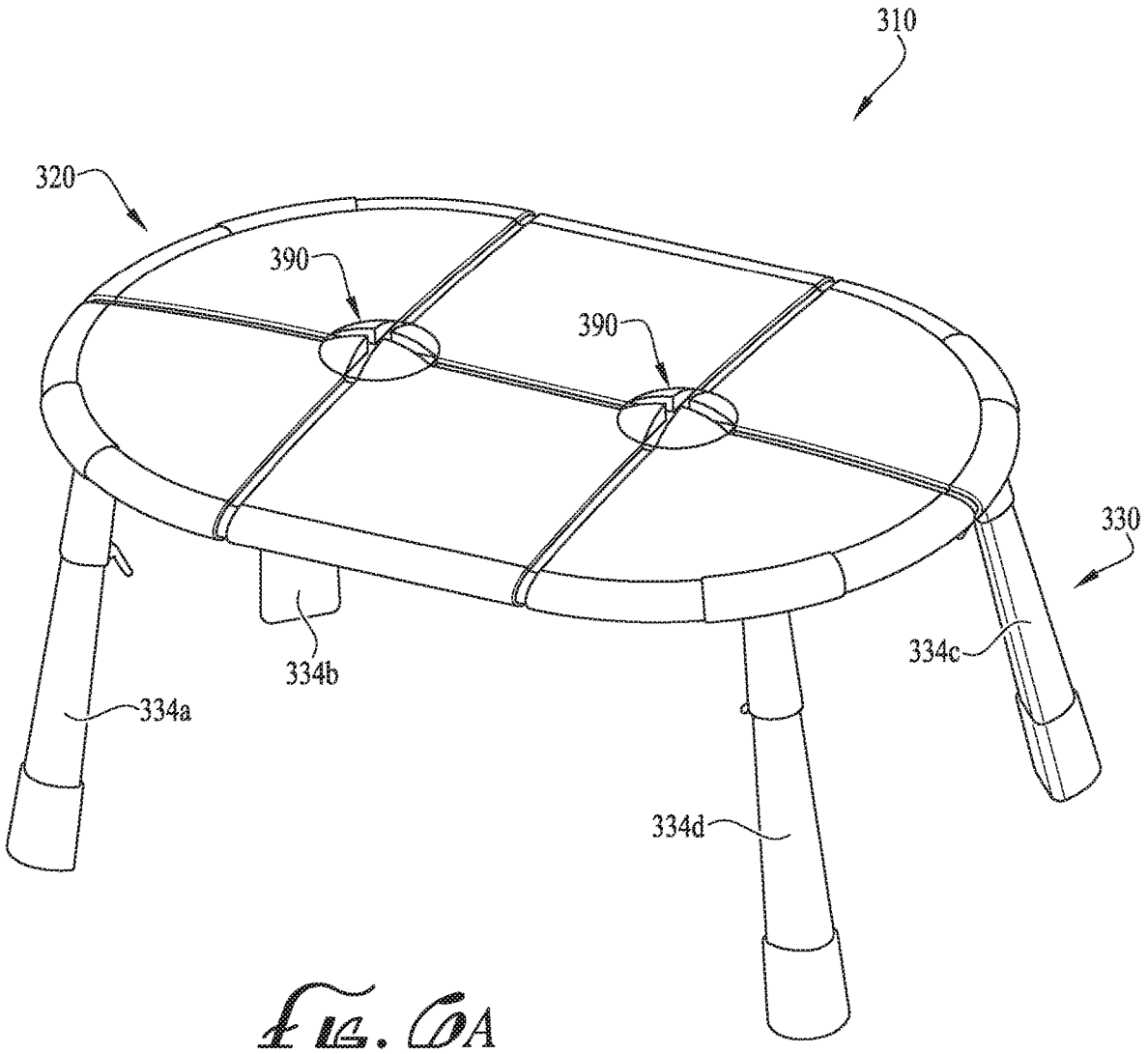
FIGS. 6A, 6B, 6C and 6D show a modular play table and associated kit of modular assembly components according to another example embodiment of the present disclosure.
Figure 6B:
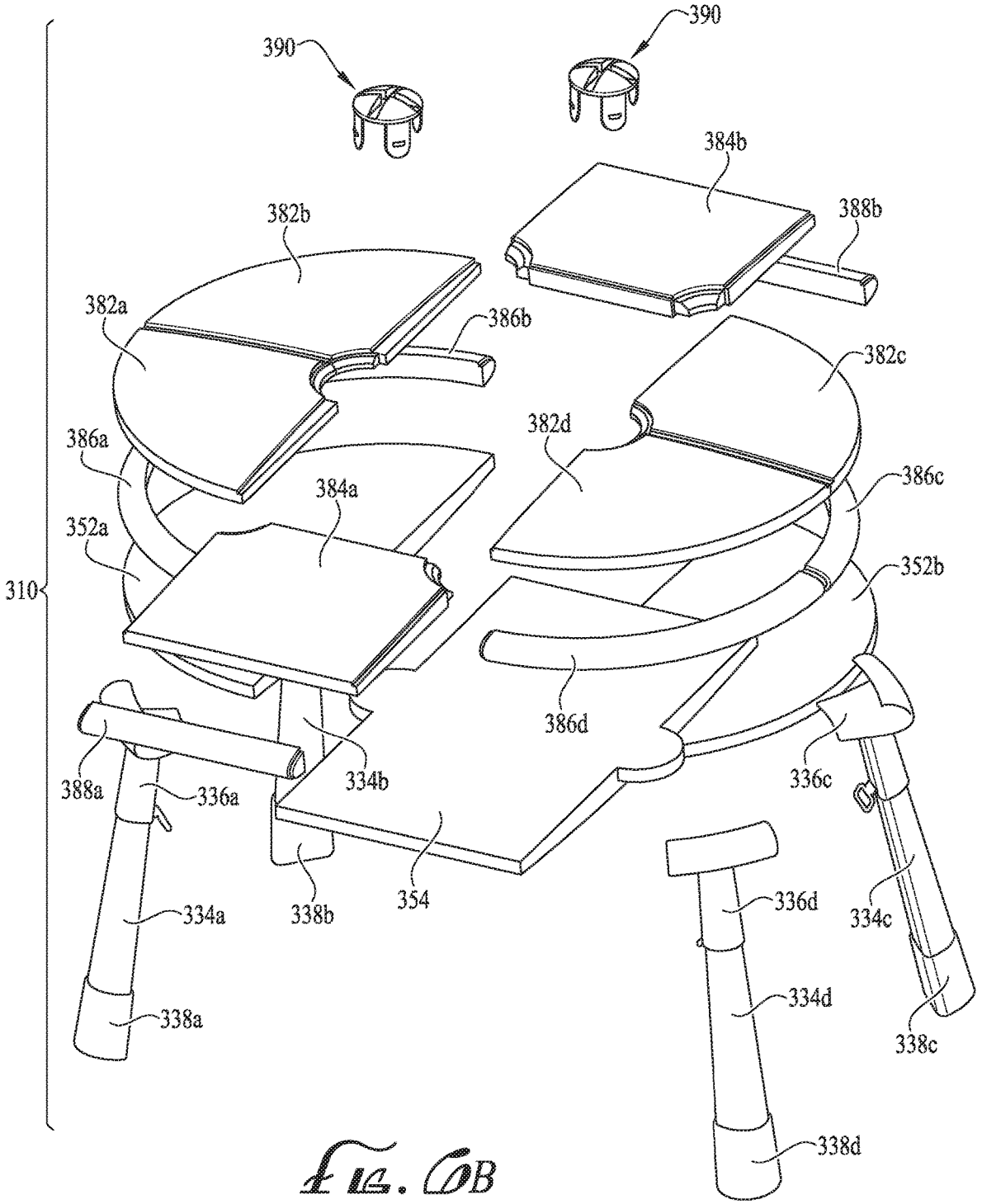
Figure 6C:
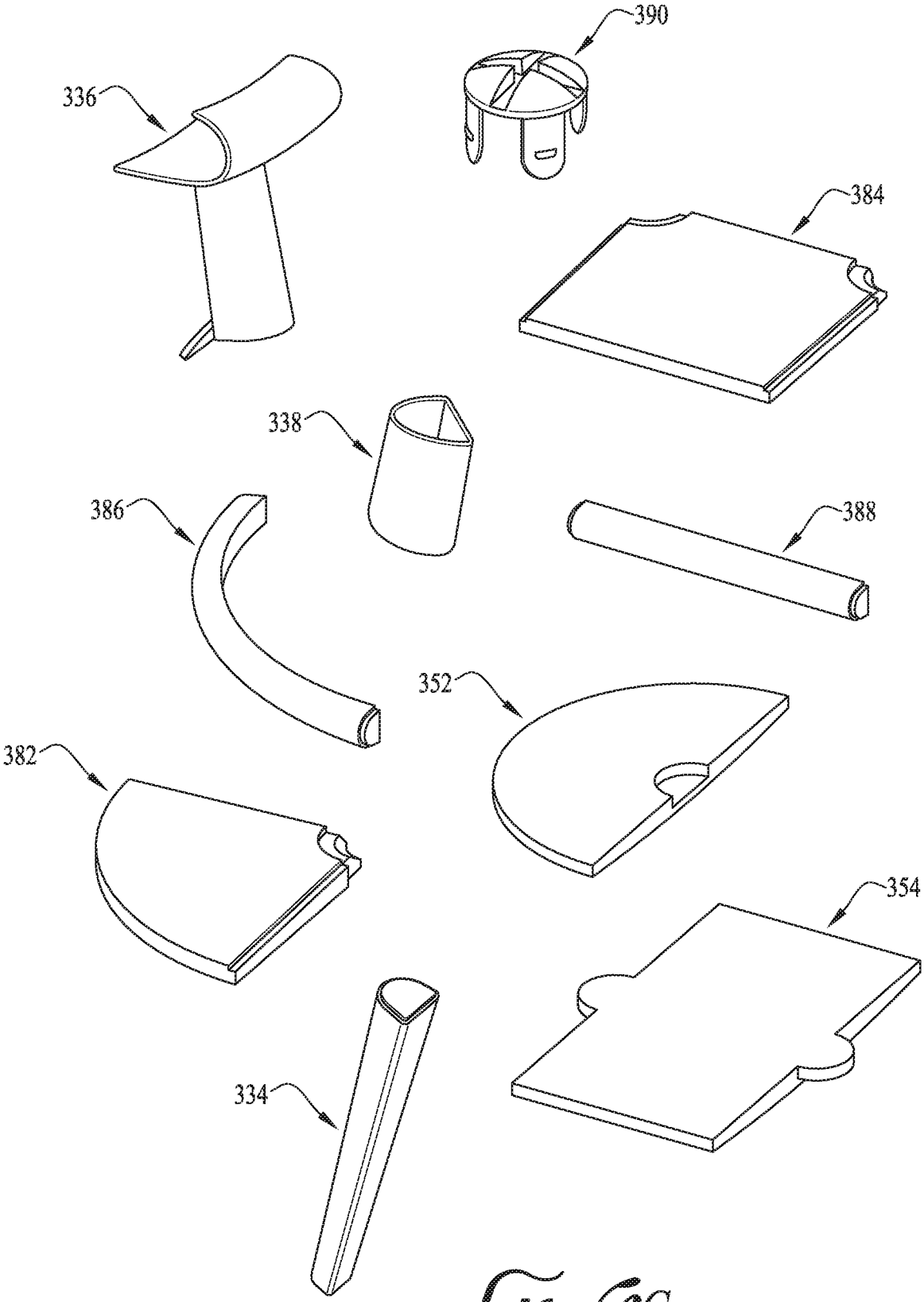
Figure 6D:
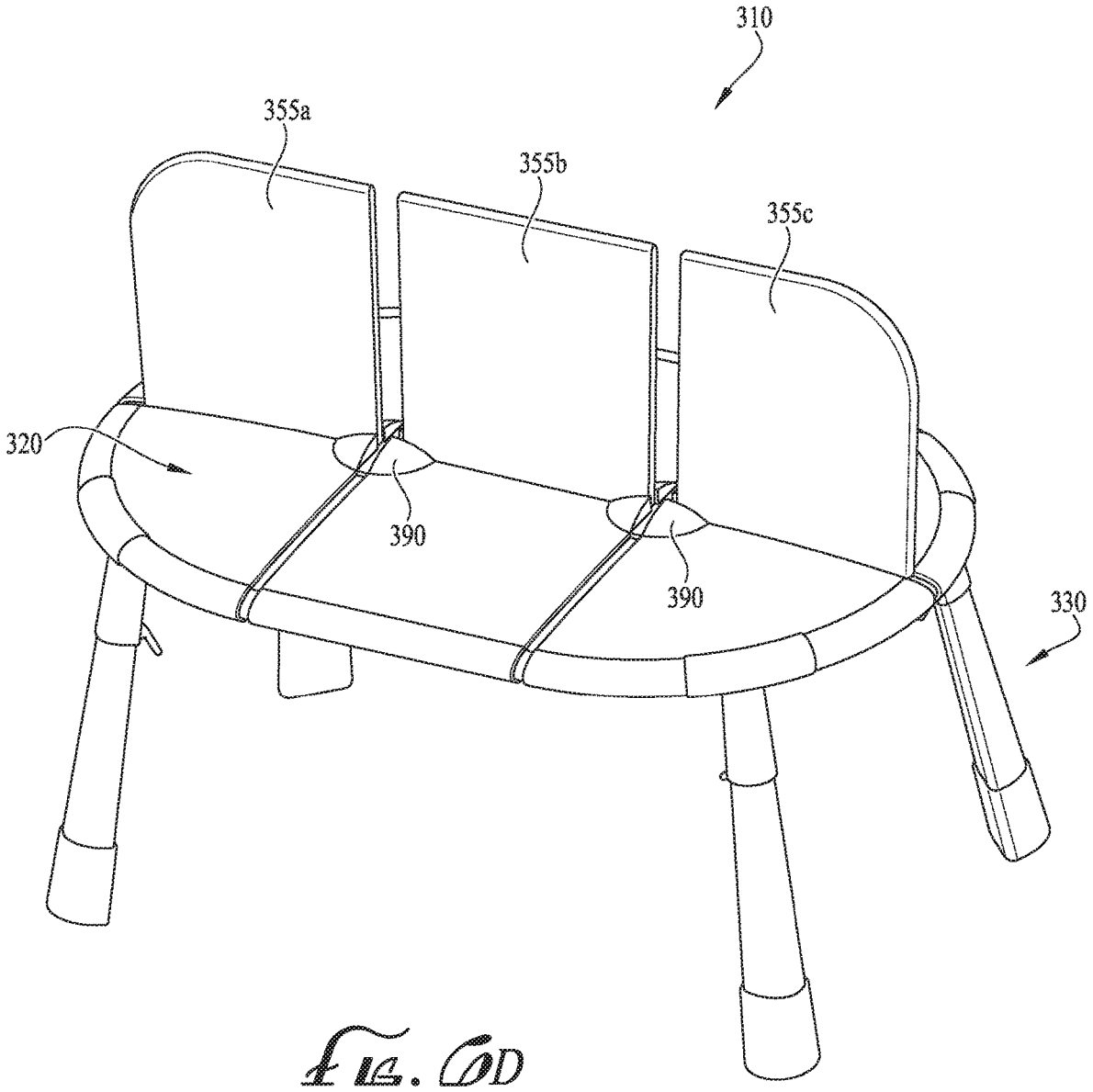

FIGS. 6A, 6B, 6C and 6D show a modular play table 310 and associated kit of modular assembly components according to another example embodiment of the present disclosure. Table 310 is generally similar to the above-described embodiments, with differences as noted. The table 310 generally comprises a tabletop portion 320 supported above a base portion 330. The table base 330 comprises one or more generally upright support legs 334 (four legs 334*a*, 334*b*, 334*c*, 334*d* are present in the depicted embodiment). Each leg 334 optionally comprises a leg support 336 configured to detachably couple an upper end of the respective leg to the tabletop 320, and a foot 338 at a lower end of the leg for contacting the floor or other support surface. The leg supports 336 optionally include a connector for a diagonal brace between the leg 334 and the tabletop 320. In the depicted embodiment, the tabletop portion 320 includes a modular table-top support panel comprising first and second side table base insert panels 352*a*, 352*b* at opposite ends thereof, and at least one mid-table base insert panel 354 coupled between the side table base insert panels. In the depicted embodiment, the tabletop portion 320 also includes one or more modular table accessory panels, such as for example, quarter-circular (90°) table quadrants 382 (four table quadrants 382*a*, 382*b*, 382*c*, 382*d* are present in the depicted embodiment) and table side tops 384 (two table side tops 384*a* and 384*b* are present in the depicted embodiment). In example embodiments, the modular table accessory panels may include one or more toys or accessories and are optionally configured for detachable and interchangeable connection with the table base 330 and/or the table-top support panel, in similar fashion to the above described embodiments. The tabletop portion 320 optionally also includes a peripheral support ring extending around its outer periphery to retain the components of the modular table-top support panel and/or the modular table accessory panels in their assembled configuration, for example comprising one or more radiused end table supports 386 and/or side table supports 388. In the depicted embodiment, two quarter-circular (90°) radiused end table supports 386*a*, 386*b* are provided at a first end of the tabletop 320, and two more radiused end table supports 386*c*, 386*d* are provided at an opposite end of the tabletop, with two side table supports 388*a*, 388*b* between the end table supports at opposite sides of the tabletop. The end table supports 386 and side table supports 388 optionally include cooperatively interengaging detachable coupling elements at each end thereof for attachment together to form a peripheral ring to retain the tabletop in its assembled configuration. The leg supports 336 optionally include receivers or coupling elements for detachable engagement with the end table supports 386 and/or the side table supports 388, or to other components of the tabletop 320 to attach the legs 334 of the base 330 to the tabletop. Similar to the previously described embodiment, one or more (two are present in the depicted embodiment) central locking table cap(s) or hub(s) 390 may be installed into or onto the tabletop 320, optionally including one or more slots or other engagement features for detachably installing one or more upright divider panels 355, as shown in FIG. 6D (three panels 355*a*, 355*b*, 355*c* are present in the depicted embodiment).

The example embodiments disclosed herein comprise various components and parts which may be assembled, disassembled, and reassembled into various configurations in modular fashion, as described and shown herein. For example, the walker portion may be connected to or removed from the play table. The modular table accessory panels may be interchangeably installed and replaced. The leg components of the table may be interchangeable with the legs of the walker and/or other product configurations. The mid table base insert and/or table side tops may be utilized to assemble an oval or elongate table or can be removed and omitted to assemble a round or circular table. Various other combinations and sub-combinations of modular components may be utilized in similar fashion. The various components may be provided separately, or together in the form of a kit or system comprising any two or more of said components in combination. For example, a kit or system of components may be provided as shown in FIG. 6C, comprising any or all of: four leg supports, four feet, four table supports, four table quadrants, four leg parts, two table caps, two table side tops, two side table supports, two side table base inserts, and/or one mid-table base insert components. In alternate embodiments more or fewer of each component type may be provided, additional component types may be included, and/or one or more component types may be omitted. In further example embodiments, instructions for assembling one, two or more modular products or assemblies can be provided, for example in the form of a booklet or written and/or graphical instructions, online video instructions, a mobile phone app, or other instructional means are optionally provided. In further example embodiments, one or more tools may optionally be included for assembling the components.

In still further alternate embodiments, a table according to the present disclosure can be configured for adult or other use, for example as a work table, dining table, conference table, desk, medical examination table, retail display platform, and/or other configurations for different applications.

In some embodiments, one or more of the modular accessory panels may be flat rather than having toys or accessories mounted thereon. In other embodiments, the accessory panels may include other features such as electronic keyboards, touchpads, video display panels, electronic menu and ordering systems, audio speakers, microphones, etc., allowing user customization for various purposes or applications. In further embodiments, the table-top support panel or table base may include electric power, electronic data, fluid delivery, mechanical, magnetic, and/or other connection elements or ports positioned to align and connect with cooperating connection elements on the modular table accessory panels when assembled.

While the invention has been described with reference to example embodiments, it will be understood by those skilled in the art that a variety of modifications, additions, and deletions are within the scope of the invention, as defined by the following claims.

What is claimed is:

1. A children's play table and walker, comprising:

a play table portion comprising a table base, a mounting hub supported by the table base, a support panel configured for attachment to the mounting hub, and a plurality of modular table accessory panels configured for interchangeable coupling with the support panel; and a walker portion comprising a seat portion having a seat for supporting a child therein, a connecting portion extending from the seat platform and configured for rotational coupling with the play table portion, and at least one walker support leg having a proximal end attached to the seat platform and a distal end comprising a wheel.

2. The play table and walker of claim 1, wherein the mounting hub and the support panel comprise interengaging detachable coupling elements.

3. The play table and walker of claim 2, wherein the interengaging detachable coupling elements comprise recessed receivers in the mounting hub having downwardly inclined sliding contact surfaces, and guidance members extending from the support panel, wherein the guidance members are configured to align with the recessed receivers and move along the downwardly inclined sliding contact surfaces to provide gravity-assisted connection of the support panel to the mounting hub.

4. The play table and walker of claim 3, wherein the interengaging detachable coupling elements further comprise at least one locking element on the mounting hub and at least one retention element on the support panel, wherein the locking element and the retention member are configured for releasable engagement to resist detachment of the support panel from the mounting hub.

5. The play table and walker of claim 3, wherein the guidance members each comprise an obliquely inclined contact surface configured to align with the inclined sliding contact surfaces of the recessed receivers in the mounting hub.

6. The play table and walker of claim 3, wherein the recessed receivers in the mounting hub define an arcuate curved path, whereby the gravity-assisted connection of the support panel to the mounting hub comprises a rotational and downward motion of the support panel relative to the mounting hub.

7. The play table and walker of claim 1, wherein at least one of the plurality of modular table accessory panels comprises a children's play accessory.

8. The play table and walker of claim 1, wherein the modular table accessory panels define a circular sector profile having first and second radial side edges and an arcuate outer peripheral edge extending between the first and second radial side edges.

9. The play table and walker of claim 8, wherein the circular sector profile of the modular table accessory panels defines a 90° sector generally corresponding to one-quarter of a circle.

10. The play table and walker of claim 1, wherein the support panel and the modular table accessory panels comprise interengaging detachable coupling elements.

11. The play table and walker of claim 1, wherein the walker portion is detachable from the play table portion for independent use of the play table portion without the walker portion.

12. The play table and walker of claim 1, further comprising at least one upright divider panel configured for removable attachment onto the play table portion.

13. A table comprising a table base and a tabletop assembly configured for attachment to the table base, wherein the tabletop assembly comprises a plurality of modular table accessory panels configured for detachable and interchangeable connection with the table base, further comprising a mounting hub supported by the table base, and a support panel configured for attachment to the mounting hub, wherein the modular table accessory panels detachably couple with the support panel to form the tabletop assembly.

14. The table of claim 13, wherein the table is a children's play table and at least one of the plurality of modular table accessory panels comprises a children's play accessory.

15. The table of claim 13, wherein the modular table accessory panels define a circular sector profile having first and second radial side edges and an arcuate outer peripheral edge extending between the first and second radial side edges.

16. The table of claim 15, wherein the circular sector profile of the modular table accessory panels defines a 90° sector generally corresponding to one-quarter of a circle.

17. The table of claim 13, wherein the mounting hub comprises recessed receivers having downwardly inclined contact surfaces, and wherein the support panel comprises guidance members configured to align with the recessed receivers and move along the downwardly inclined sliding contact surfaces to provide gravity-assisted connection of the support panel to the mounting hub.

18. The table of claim 17, further comprising at least one locking element on the mounting hub and at least one retention element on the support panel, wherein the locking element and the retention member are configured for releasable engagement to resist detachment of the support panel from the mounting hub.

19. The table of claim 17, wherein the guidance members each comprise an obliquely inclined contact surface configured to align with the inclined sliding contact surfaces of the recessed receivers in the mounting hub.

20. The table of claim 17, wherein the recessed receivers in the mounting hub define an arcuate curved path, whereby the gravity-assisted connection of the support panel to the mounting hub comprises a rotational and downward motion of the support panel relative to the mounting hub.

21. The table of claim 13, further comprising an orbital walker portion having a seat for supporting a child therein, a connecting portion for rotational coupling with the table, and at least one walker support leg comprising a wheel, whereby a child seated in the seat can walk the walker portion along a rotational path around at least a portion of the tabletop assembly.

22. The table of claim 13, wherein the tabletop assembly is reconfigurable between a circular configuration and an oval configuration.

23. A table comprising a table base and a tabletop assembly configured for attachment to the table base, wherein the table base comprises a mounting hub having recessed receivers with downwardly inclined contact surfaces, and wherein the tabletop assembly comprises guidance members configured to align with the recessed receivers and move along the downwardly inclined sliding contact surfaces to provide gravity-assisted connection of the tabletop assembly to the table base.

24. The table of claim 23, further comprising at least one locking element on the mounting hub and at least one retention element on the tabletop assembly, wherein the locking element and the retention member are configured for releasable engagement to resist detachment of the tabletop assembly from the table base.

25. The table of claim 23, wherein the guidance members each comprise an obliquely inclined contact surface configured to align with the inclined sliding contact surfaces of the recessed receivers in the mounting hub.

26. The table of claim 23, wherein the recessed receivers in the mounting hub define an arcuate curved path, whereby the gravity-assisted connection of the tabletop assembly to the table base comprises a rotational and downward motion of the support panel relative to the mounting hub.

27. The table of claim 23, wherein the tabletop assembly comprises a plurality of modular table accessory panels.

28. The table of claim 27, wherein at least one of the plurality of modular table accessory panels comprises a children's play accessory.

29. The table of claim 27, wherein the modular table accessory panels define a circular sector profile having first and second radial side edges and an arcuate outer peripheral edge extending between the first and second radial side edges.

30. The table of claim 29, wherein the circular sector profile of the modular table accessory panels defines a 90° sector generally corresponding to one-quarter of a circle.

31. The table of claim 27, further comprising a support panel configured for attachment to the mounting hub, and wherein the plurality of modular table accessory panels detachably couple with the support panel to form the tabletop assembly.

32. The table of claim 23, further comprising an orbital walker portion having a seat for supporting a child therein, a connecting portion for rotational coupling with the table, and at least one walker support leg comprising a wheel, whereby a child seated in the seat can walk the walker portion along a rotational path around at least a portion of the tabletop assembly.

33. A kit comprising a plurality of components for modular assembly into at least two different product configurations, the components selected from a component group comprising base support components, tabletop components comprising modular table accessory panels configured for detachable and interchangeable connection with the base support components, and walker components, and the product configurations selected from a product configuration group comprising a children's walker product configuration and a children's play table product configuration.

34. A table comprising a table base and a tabletop assembly configured for attachment to the table base, wherein the tabletop assembly comprises a plurality of modular table accessory panels configured for detachable and interchangeable connection with the table base, further comprising an orbital walker portion having a seat for supporting a child therein, a connecting portion for rotational coupling with the table, and at least one walker support leg comprising a wheel, whereby a child seated in the seat can walk the walker portion along a rotational path around at least a portion of the tabletop assembly.

* * * * *